US008218988B2

(12) United States Patent
Tomita

(10) Patent No.: US 8,218,988 B2
(45) Date of Patent: Jul. 10, 2012

(54) IMAGE FORMING APPARATUS WITH TRANSFER BELT CLEANING FUNCTION

(75) Inventor: Norio Tomita, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 473 days.

(21) Appl. No.: 12/497,783

(22) Filed: Jul. 6, 2009

(65) Prior Publication Data

US 2010/0014878 A1 Jan. 21, 2010

(30) Foreign Application Priority Data

Jul. 15, 2008 (JP) ..... 2008-183643

(51) Int. Cl.
*G03G 15/00* (2006.01)
*G03G 21/00* (2006.01)

(52) U.S. Cl. ..... 399/49; 399/98

(58) Field of Classification Search ..... 399/49, 399/98

See application file for complete search history.

(56) References Cited

U.S. PATENT DOCUMENTS 6,321,044 B1 11/2001 Tanaka ..... 399/49
7,366,437 B2 4/2008 Inui et al. ..... 399/98
8,055,145 B2 * 11/2011 Tomita et al. ..... 399/49
2004/0042816 A1 * 3/2004 Fukuda et al. ..... 399/98
2006/0171727 A1 8/2006 Inui et al. ..... 399/27
2006/0285863 A1 * 12/2006 Noguchi et al. ..... 399/49

FOREIGN PATENT DOCUMENTS

CN 1818809 A 8/2006
JP 2001-100597 A 4/2001
JP 2004-184710 A 7/2004
JP 2005-70676 A 3/2005
JP 2007-272154 A 10/2007

* cited by examiner

*Primary Examiner* — David Gray
*Assistant Examiner* — Andrew Do
(74) *Attorney, Agent, or Firm* — Nixon & Vanderhye P.C.

(57) ABSTRACT

To provide an image forming apparatus which can prevent malfunction of the open/close control of a shutter due to erroneous detection of the toner on the transfer belt when the opening and closing of the shutter is detected from the output from an optical sensor. The separation/contact assembly for moving a cleaning member into and out of contact includes an arm rotationally supported on a pivot, an abutment part fixed to the body frame so as to limit the rotation of the arm and a spring for pressing the arm in the clockwise direction. The cleaning member is attached at the distal end of the arm. The cleaning member cleans the transfer belt surface when the shutter is closed, so that the cleaned transfer belt surface can be always detected when the shutter is open.

11 Claims, 22 Drawing Sheets

Density Sensor Unit (Closed State)

Density Sensor Unit (Open State)

Shutter-closed State

Shutter-open State

IMAGE FORMING APPARATUS WITH TRANSFER BELT CLEANING FUNCTION

This Nonprovisional application claims priority under 35 U.S.C. §119 (a) on Patent Application No. 2008-183643 filed in Japan on Jul. 15, 2008, the entire contents of which are hereby incorporated by reference.

BACKGROUND OF THE TECHNOLOGY

1. Field of the Technology

The present technology relates to an image forming apparatus such as a printer, copier or the like, which forms images on sheets of paper, in particular, relating to an image forming apparatus with a transfer belt cleaning function for preventing an optical sensor that detects the density and misregistration of the image, from detecting shutter opening and closing in error.

In image forming apparatuses based on electrophotography, a test pattern image (reference toner image) is often used in order to check whether the image forming process is correctly carried out. Typical examples of test pattern images include the toner image for density measurement and the toner image for positional check.

This test of the image forming process is carried out by forming a reference toner image on a trial basis and sensing the density and position of the thus formed reference toner image with an optical sensor so as to detect whether a toner image having a correct density is formed at an exact position. In this test, if the conditions of the image forming process are not pertinent, the image forming process conditions are corrected in accordance with the detected result of the optical sensor. This test using a reference toner image is periodically implemented, whereby it is possible to achieve image forming operations under pertinent conditions.

In color image forming apparatuses, it is impossible to correctively reproduce a color image unless images of color separations are laid over in register with each other. For this purpose, the above-described detection, or check on whether there is any problem with toner density and image position, is periodically implemented using an optical sensor with a reference toner image.

However, the optical sensors used for toner density sensing and registration sensing have to be arranged at positions where an unfixed toner passes through. Besides, the aforementioned reference toner image is formed on the transfer belt and detected by the optical sensors, and in order to achieve reliable detection, the sensors have to be positioned at the most downstream side in the image forming process.

2. Description of the Related Art

Accordingly, quite a few amount of unfixed toner scatters when the recording medium (paper) is transferred from the toner belt to the fusing device. As a result, unfixed toner gradually builds up on the detection surface of the sensors, possibly causing deterioration in detection and detection failure.

To deal with this problem, JP2001-100597A, discloses a configuration in which a shutter is provided in the vicinity of the detecting surface of an optical sensor in an openable and closable manner so that the shutter will open to permit detection only for the time of measurement and will close itself otherwise, to thereby prevent adherence of unfixed toner. Further, the opening and closing of the shutter that protects the detecting face of the optical sensor for detecting the light reflected off the reference toner image against toner may be detected based on the reflected light from the transfer belt, whereby it is possible to check whether the shutter is correctly opened or closed without providing a separate sensor for detecting the opening and closing of the shutter.

However, in the above configuration, if a toner has adhered on the transfer belt when the shutter changes its position from the closed state (no direct light reflection received) to the open state (direct light reflection received), the optical sensor receives no direct light reflection due to the toner, and hence erroneously detects the shutter being closed even though the shutter is opened.

In the configuration described above, if, for example, a trouble has occurred in the main charger for charging the photoreceptor, the toner has adhered on the entire surface of the photoreceptor, and the toner extensively transfers to the transfer belt. When the opening and closing of the shutter is detected based on the presence/absence of reflected light, no direct light reflection cannot be detected due to the toner. As a result, even though the shutter is correctly opened and closed, the malfunction of the shutter's opening and closing mechanism is mistakenly detected. That is, it is impossible to distinguish the malfunction of the shutter from other failures (the operation failure of the main charger), and time-consuming checking process is consequently needed and/or there occurs another risk of doing repairs in a wrong manner.

Summary of The Technology

In view of what has been described above, it is therefore an aspect of the present technology to provide an image forming apparatus including a transfer belt cleaning function, in which when the open/close status of the shutter is detected by the optical sensor, the malfunction of the open/close control of the shutter due to erroneous detection of the toner on the transfer belt can be prevented.

According to the first aspect of the present technology, an image forming apparatus with a transfer belt cleaning function comprises: a transfer belt for receiving a toner image from a photoreceptor; a secondary transfer unit for transferring the toner image on the transfer belt to a recording medium; an optical sensor for detecting a reference toner image on the transfer belt; a shutter for protecting the detecting surface of the optical sensor; an opening/closing portion for opening and closing the shutter; a controller for detecting the opening and closing of the shutter from the output from the optical sensor and controlling the opening and closing action of the shutter based on the detected result; a cleaning member disposed on the upstream side, with respect to the transfer belt's direction of conveyance, of the detecting face of the optical sensor for cleaning the surface of the transfer belt; and a cleaning member separation/contact assembly which moves the cleaning member away from the transfer belt surface when the shutter is opened and brings the cleaning member into contact with the transfer belt surface when the shutter is closed.

The second aspect of the present technology is characterized in that a plurality of optical sensors are provided, and the cleaning member and the cleaning member separation/contact assembly are provided for each of the optical sensors.

The third aspect of the present technology is characterized in that the cleaning member is arranged obliquely to the direction perpendicular to the transfer belt's direction of conveyance when the cleaning member is put in contact with the transfer belt.

The fourth aspect of the present technology is characterized in that the time from the state where the shutter in cleaning member separation/contact assembly is closed to the state where the cleaning member is moved away from the transfer belt is equal to or shorter than the time taken for the shutter in the opening and closing portion to move from the closed position to the open position.

The fifth aspect of the present technology is characterized in that when the reference toner image has been transferred to the transfer belt, the controller causes the opening and closing portion to open the shutter so that the cleaning member separation/contact assembly moves the cleaning member away from the transfer belt before the arrival of the reference toner image to the cleaning position of the cleaning member.

The sixth aspect of the present technology further comprises: a separation/contact mechanism for the transfer belt and the secondary transfer unit; and a linkage mechanism for linking the opening and closing of the shutter with the separation and contact of the secondary transfer unit.

The seventh aspect of the present technology is characterized in that the linkage mechanism moves the shutter away from the transfer belt when the secondary transfer unit is pulled out from the main apparatus body.

The eighth aspect of the present technology is characterized in that the linkage mechanism includes a lever that abuts the secondary transfer unit and the shutter, the lever being moved by a driving mechanism so as to move the shutter and the secondary transfer unit into, and out of, contact with each other.

The ninth aspect of the present technology is characterized in that the optical sensor is a sensor that detects the density of a reference toner image on the transfer belt.

The tenth aspect of the present technology is characterized in that the optical sensor is a sensor that detects the position of a reference toner image of the transfer belt.

The eleventh aspect of the present technology is characterized in that, when a plurality of optical sensors are provided, the optical sensors are adapted to use a common shutter.

The twelfth aspect of the present technology is characterized in that the controller monitors change of the output from the optical sensor and performs an error process when no change has been observed for a predetermined period of time or longer.

According to the present technology, the cleaning member is moved away from the transfer belt surface when the shutter is opened and the cleaning member is put into contact with the transfer belt surface when the shutter is closed. Accordingly, it is possible to prevent the failure in detecting the opening/closing of the shutter as a result of abnormal adherence of toner on the transfer belt at the position to be detected by the optical sensor, and hence shorten the time for checking work and provide appropriate repairs.

Further, since the cleaning member and the cleaning member separation/contact assembly are provided for each of the multiple optical sensors, the above effect can be obtained from any of the optical sensors.

Since the cleaning member is arranged obliquely to the direction perpendicular to the transfer belt's direction of conveyance when the cleaning member is put in contact with the transfer belt, it is possible to turn aside the toner being cleaned by the cleaning member, in the transfer belt's direction of conveyance and prevent toner from building up on the cleaning member.

Since the time from the state where the shutter in cleaning member separation/contact assembly is closed to the state where the cleaning member is moved away from the transfer belt is equal to or shorter than the time taken for the shutter in the opening and closing portion to move from the open position to the closed position, it is possible to guarantee the cleaning member to reliably remove the toner on the transfer belt.

When the reference toner image has been transferred to the transfer belt, the shutter is opened so that the cleaning member separation/contact assembly moves the cleaning member away from the transfer belt before the reference toner image arrives at the cleaning position of the cleaning member. As a result, the cleaning member will never clean the reference toner image by mistake, it is hence possible to examine whether or not the image forming process is correctly carried out.

Further, since the opening and closing of the shutter is linked with the separation and contact of the secondary transfer unit on the basis of the linkage mechanism, the reference toner image formed on the transfer belt will not be rubbed by the secondary transfer unit, it is hence possible with the optical sensor to detect the density and position of the reference toner image in a more exact manner.

Since the linkage mechanism moves the shutter away from the transfer belt when the secondary transfer unit is pulled out from the main apparatus body, it is possible to prevent the shutter from colliding with the transfer belt surface and damaging the transfer belt when secondary transfer unit is detached from and mounted to the main body (at the time of replacement).

Since, when multiple optical sensors are provided, the optical sensors are adapted to use a common shutter, the multiple optical sensors can be handled with only one set of the shutter and its opening and closing mechanism, it is hence possible to avoid parts increasing in number.

Since an error process is performed when no change has been observed for a predetermined period of time or longer by monitoring change of the output from the optical sensor, it is possible to prevent the malfunction of the open/close control of the shutter, which results in the failure in detecting the opening/closing of the shutter

DESCRIPTION OF THE PREFERRED EMBODIMENTS

The embodiment of the present technology will hereinafter be described with reference to the accompanying drawings.

Figure 1:
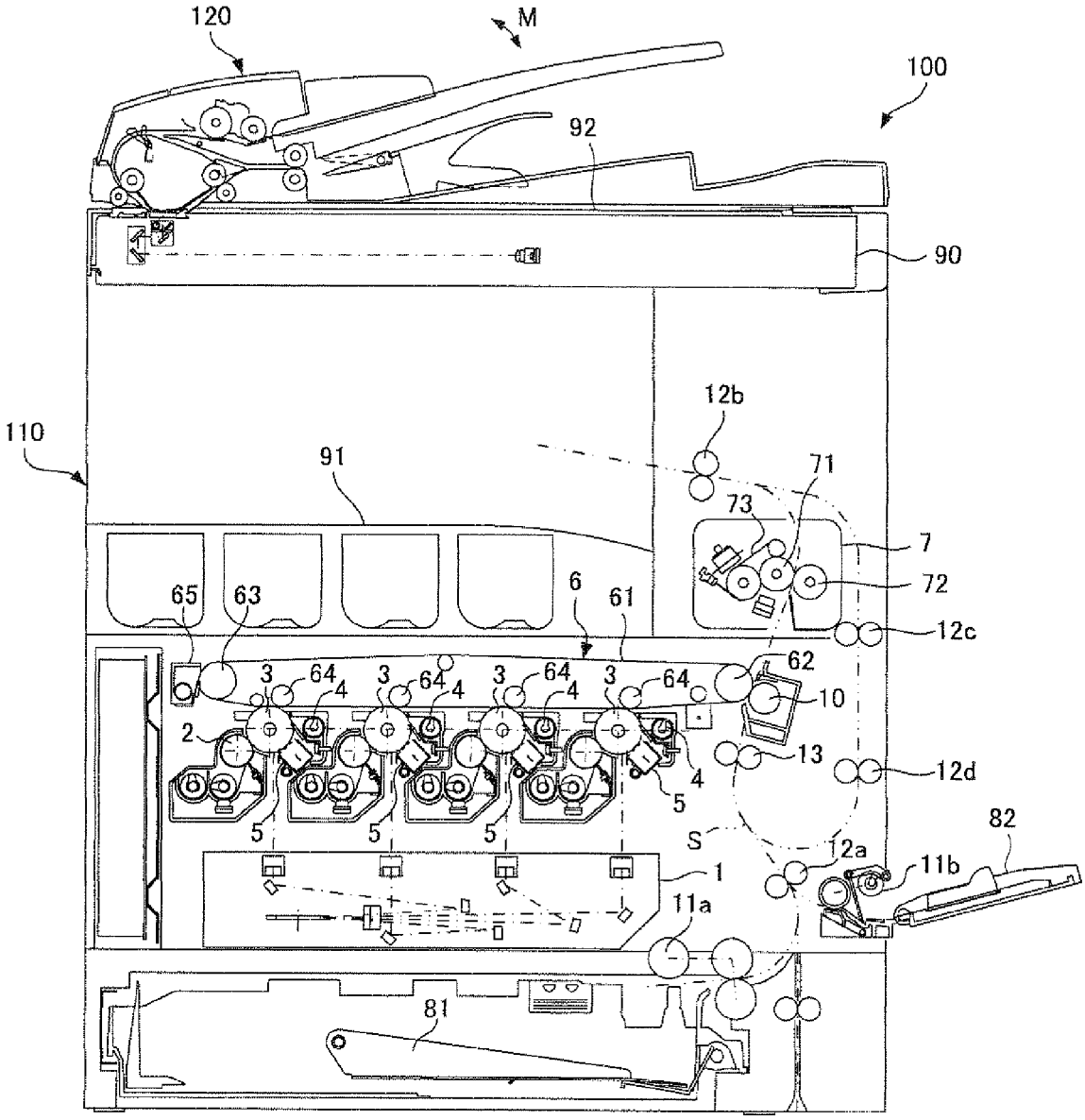
FIG. 1 is a schematic overall view showing one example of an image forming apparatus according to the present technology.

FIG. 1 shows a schematic configuration of an image forming apparatus 100 for embodying the present technology.

Image forming apparatus 100 forms a multi-colored or monochrome image on a predetermined sheet (recording paper) in accordance with image data transmitted from the outside, and is composed of a main apparatus body 110 and an automatic document processor 120. Main apparatus body 110 includes: an exposure unit 1; developing units 2, photoreceptor drums 3, cleaning units 4, chargers 5, an intermediate transfer belt unit 6, a fusing unit 7, a paper feed cassette 81 and a paper output tray 91.

Arranged on top of main apparatus body 110 is a document table 92 made of a transparent glass plate on which a document is placed. On the top of document table 92, automatic document processor 120 is mounted. Automatic document processor 120 automatically feeds documents onto document table 92. This document processor 120 is constructed so as to be pivotable in the bidirectional arrow M so that a document can be manually placed by opening the top of document table 92.

The image data handled in the image forming apparatus is data for color images of four colors, i.e., black (K), cyan (C), magenta (M) and yellow (Y). Accordingly, four developing units 2, four photoreceptor drums 3, four chargers 5, four cleaning units 4 are provided to produce four electrostatic latent images corresponding to black, cyan, magenta and yellow. That is, four imaging stations are constructed thereby.

Charger 5 is the charging device for uniformly electrifying the surface of the photoreceptor drum 3 at a predetermined potential. Other than the corona-discharge type chargers shown in FIG. 1, chargers of a contact roller type or a brush type may also be used.

Exposure unit 1 corresponds to the image writing device of the present technology, and is constructed as a laser scanning unit (LSU) having a laser emitter, reflection mirrors, etc. In this exposure unit 1, a polygon mirror for scanning a laser beam, optical elements such as lenses and mirrors for leading the laser beam reflected off the polygon mirror to photoreceptor drums 3 are laid out. The configuration of the optical scanning unit that constitutes exposure unit 1 will be described later in a specific manner.

As exposure unit 1, other methods using an array of light emitting elements such as an EL or LED writing head, for example may be used instead.

This exposure unit 1 has the function of illuminating each of the electrified photoreceptor drums 3 with light in accordance with the input image data to form an electrostatic latent image corresponding to the image data on each photoreceptor drum surface. Developing units 2 visualizes the electrostatic latent images formed on photoreceptor drums 3 with four color (YMCK) toners. Cleaning unit 4 removes and collects the toner left over on the surface of the photoreceptor drum 3 after development and image transfer.

Intermediate transfer belt unit 6 arranged over photoreceptor drums 3 is comprised of an intermediate transfer belt 61, an intermediate transfer belt drive roller 62, an intermediate transfer belt driven roller 63, four intermediate transfer rollers 64 corresponding to four YMCK colors and an intermediate transfer belt cleaning unit 65.

Intermediate transfer belt drive roller 62, intermediate transfer belt driven roller 63 and intermediate transfer rollers 64 support and tension intermediate transfer belt 61 to circulatively drive the belt. Each intermediate transfer roller 64 provides a transfer bias to transfer the toner image from photoreceptor drum 3 onto intermediate transfer belt 61.

Intermediate transfer belt 61 is arranged so as to contact with each photoreceptor drum 3. The toner images of different colors formed on photoreceptor drums 3 are sequentially transferred in layers to intermediate transfer belt 61, forming a color toner image (multi-color toner image) on intermediate transfer belt 61. This intermediate transfer belt 61 is an endless film of about 100 μm to 150 μm thick, for example.

Transfer of toner images from photoreceptor drums 3 to intermediate transfer belt 61 is performed by intermediate transfer rollers 64 that are in contact with the rear side of intermediate transfer belt 61. Each intermediate transfer roller 64 has a high-voltage transfer bias (high voltage of a polarity (+) opposite to the polarity (−) of the static charge on the toner) applied thereto in order to transfer the toner image. This intermediate transfer roller 64 is a roller that is formed of a base shaft made of metal (e.g., stainless steel) having a diameter of 8 to 10 mm and a conductive elastic material (e.g., EPDM, foamed urethane or the like) coated on the shaft surface. This conductive elastic material enables uniform application of a high voltage to intermediate transfer belt 61. Though in the present embodiment, rollers are used as the transfer electrodes, brushes or the like can also be used instead.

The visualized electrostatic images of color toners on different photoreceptor drums 3 are laid over one after another on intermediate transfer belt 61. The thus laminated image information is transferred to the paper as intermediate transfer belt 61 rotates, by an aftermentioned transfer roller 10 that is arranged at the contact position between the paper and intermediate transfer belt 61.

In this process, intermediate transfer belt 61 and transfer roller 10 are pressed against each other forming a predetermined nip while a voltage for transferring the toner to the paper (a high voltage of a polarity (+) opposite to the polarity (−) of the static charge on the toner) is applied to transfer roller 10. Further, in order to constantly obtain the above nip, either transfer roller 10 or intermediate transfer belt drive roller 62 is formed of a hard material (metal or the like) while the other is formed of a soft material such as an elastic roller or the like (elastic rubber roller, foamed resin roller etc.).

Since the toner adhering to intermediate transfer belt 61 as the belt comes in contact with photoreceptor drums 3, or the toner which has not been transferred by transfer roller 10 from intermediate transfer belt 61 to the paper and remains thereon, would cause color contamination of toners at the next operation, the remaining toner is adapted to be removed and collected by intermediate transfer belt cleaning unit 65. Intermediate transfer belt cleaning unit 65 includes, for example a cleaning blade as a cleaning member that comes in contact with intermediate transfer belt 61. Intermediate transfer belt 61 is supported from its interior side by intermediate transfer belt driven roller 63, at the portion where this cleaning blade comes into contact with the belt.

Paper feed cassette 81 is a tray for stacking sheets (recording paper) to be used for image forming and is arranged under exposure unit 1 of main apparatus body 110. There is also a manual paper feed cassette 82 on which sheets for image forming can be set. Paper output tray 91 arranged in the upper part of main apparatus body 110 is a tray on which the printed sheets are collected facedown.

Main apparatus body 110 further includes a paper feed path S that extends approximately vertically to convey the sheet from paper feed cassette 81 or manual paper feed cassette 82 to paper output tray 91 by way of transfer roller 10 and fusing unit 7. Arranged along paper feed path S from paper feed cassette 81 or manual paper feed cassette 82 to paper output tray 91 are pickup rollers 11*a* and 11*b*, a plurality of feed rollers 12*a* to 12*d*, a registration roller 13, transfer roller 10, fusing unit 7 and the like.

Feed rollers 12*a* to 12*d* are small rollers for promoting and supporting conveyance of sheets and are arranged at different positions along paper feed path S. Pickup roller 11*a* is arranged near the end of paper feed cassette 81 so as to pick up the sheet, one sheet at a time, from paper feed cassette 81 and deliver the sheet to paper feed path S. Similarly, pickup roller 11*b* is arranged near the end of manual paper feed cassette 82 so as to pick up the sheet, one sheet at a time, from manual paper feed cassette 82 and deliver the sheet to paper feed path S.

Registration roller 13 temporarily retains the sheet that is conveyed along paper feed path S. That is, this roller has the function of delivering the sheet toward transfer roller 10 at such a timing that the front end of the sheet will meet the front end of the toner image formed on intermediate transfer belt 61.

Fusing unit 7 includes a heat roller 71 and a pressing roller 72. Heat roller 71 and pressing roller 72 are arranged so as to rotate while nipping the sheet. This heater roller 71 is set at a predetermined fusing temperature by the controller in accordance with the signal from an unillustrated temperature detector, and has the function of heating and pressing the toner to the sheet in cooperation with pressing roller 72, so as to thermally fix the toner image transferred on the sheet to the sheet by fusing, mixing and pressing the image of multiple color toners. The fusing unit further includes an external heating belt 73 for heating heat roller 71 from the outside.

Next, the sheet feed path will be described in detail. As stated above, the image forming apparatus has paper feed cassette 81 for storing sheets beforehand, and manual paper feed cassette 82. In order to deliver sheets from the paper feed cassettes 81 and 82, pickup rollers 11*a* and 11*b* are arranged so as to lead the sheet, one sheet at a time, to feed path S.

The sheet delivered from paper feed cassettes 81 or 82 is conveyed by feed rollers 12*a* on paper feed path S to registration roller 13, by which the sheet is released toward transfer roller 10 at such a timing that the front end of the sheet meets the front end of the image information on intermediate transfer belt 61 so that the image information is transferred to the sheet. Thereafter, the sheet passes through fusing unit 7, whereby the unfixed toner on the sheet is fused by heat and fixed. Then the sheet is discharged through feed rollers 12*b* arranged downstream, onto paper output tray 91.

The paper feed path described above forms when a one-sided printing is demanded. In contrast, when a duplex printing request is demanded, the sheet whose one side is printed passes through fusing unit 7 and is held at the rear end thereof by the final feed roller 12*b*. Accordingly, the feed roller 12*b* rotates in reverse so as to lead the sheet toward feed rollers 12*c* and 12*d*. Thereafter, the sheet passes through registration roller 13 and is printed on the rear side thereof and discharged onto paper output tray 91.

Figure 2:
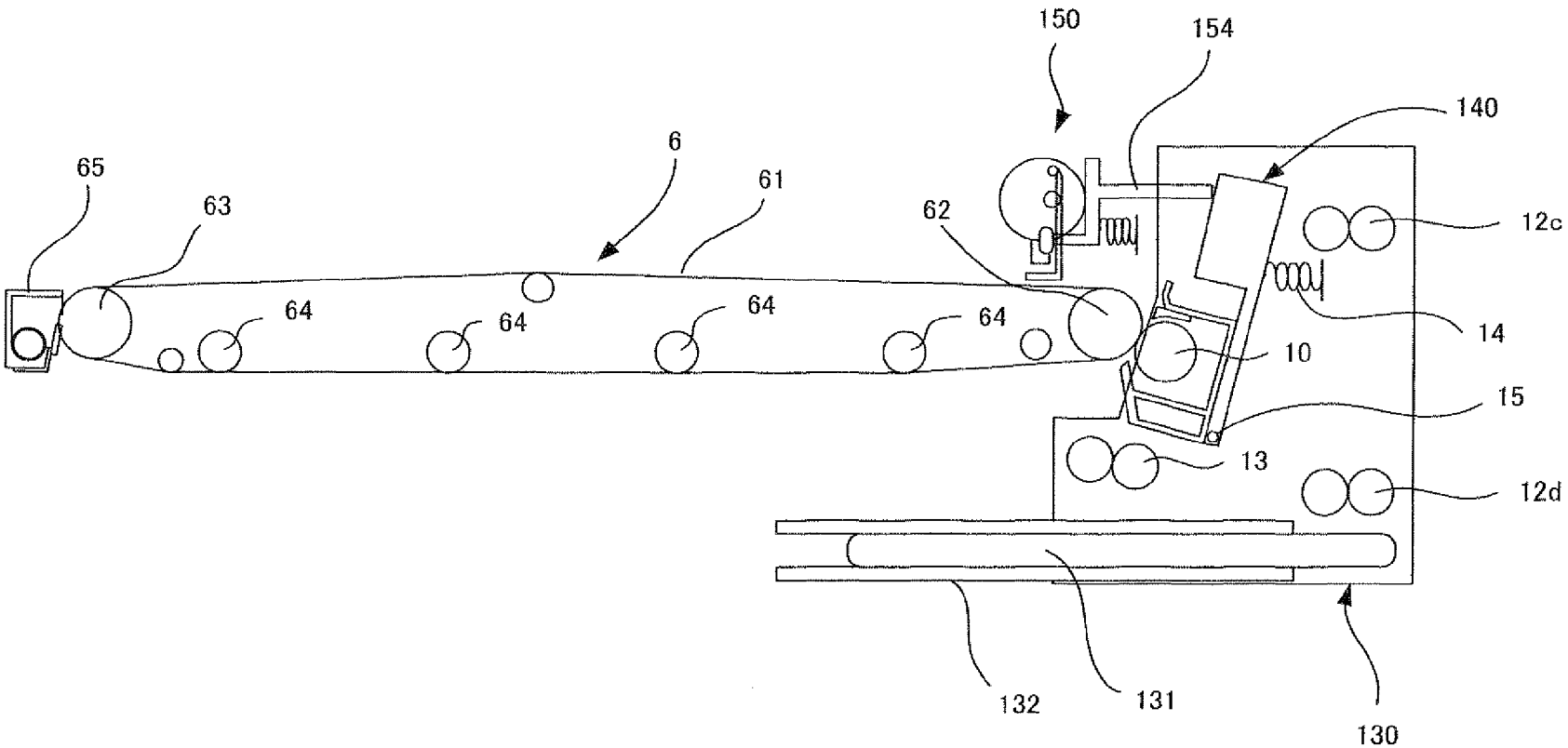
FIG. 2 is a schematic enlarged view showing a transfer portion of an image forming apparatus of the present technology.

FIG. 2 is a partial enlarged view showing a transfer portion of the image forming apparatus of the present technology.

A side unit 130 can be drawn from, and mounted into, the main apparatus body along guide rails 131 and 132. This side unit 130 includes the following components.

That is, the side unit 130 includes a secondary transfer unit 140, feed rollers 12*c* and 12*d* and a registration roller 13. The secondary transfer unit 140 includes a transfer roller 10, and is rotatably supported about a transfer pivot 15 and is pressed against a lever 154 of an aftermentioned optical sensor unit 150 by the elastic force of a spring (large) 14.

Arranged in the proximity of the side unit 130, on the main apparatus body side are the following components.

The intermediate transfer belt drive roller 62 is the roller for the driving intermediate transfer belt 61, to which the intermediate transfer belt 61 is pressed by the transfer roller 10.

Figure 3A:
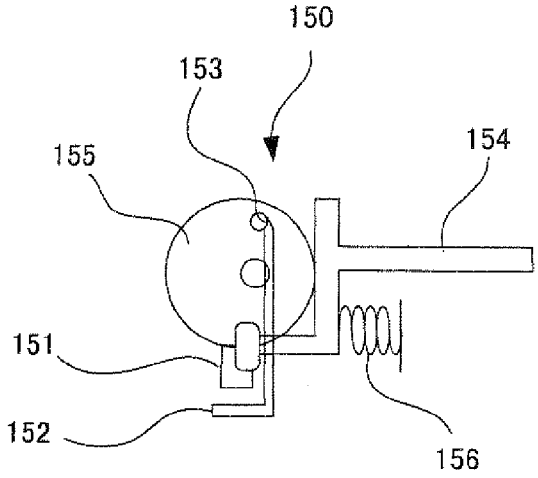
FIGS. 3A and 3B are structural views showing an optical sensor unit.
Figure 3B:
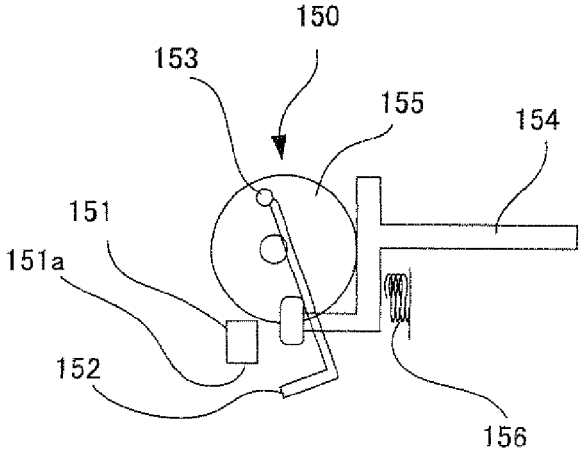

FIGS. 3A and 3B are views showing the structure of an optical sensor unit.

An optical sensor 151 includes density sensor and registration sensors. The density sensor measures the density of a first reference toner image formed on the transfer belt for controlling the processing conditions. The registration sensors are the sensors for detecting the position of a second reference toner image for color registration correction.

A shutter 152 is rotatably supported by a shutter pivot 153 and normally closed as shown in FIG. 3A, except when the reference toner image is being measured, to protect the detection surface, designated at 151*a*, of optical sensor 151 so as not to attach the toner.

As shown in FIG. 3B, the lever 154 can be moved leftwards and rightwards by an offset cam 155 and is positioned with its one end abutting shutter 152 so as to open and close the shutter 152. The other end of the lever 154 abuts the secondary transfer unit 140 so that when the lever 154 is moved rightwards in the drawing by the rotational action of the offset cam 155, the lever opens the shutter 152 while the other end of the lever 154 rotates the secondary transfer unit 140 clockwise to thereby move the secondary transfer unit 140 away from the transfer belt 61, as shown in FIG. 3B.

The offset cam 155 can be rotated by an unillustrated drive source and is rotatably supported on a camshaft.

A spring (small) 156 is provided so that its elastic force moves the lever 154 rightwards in the drawing.

Figure 4:
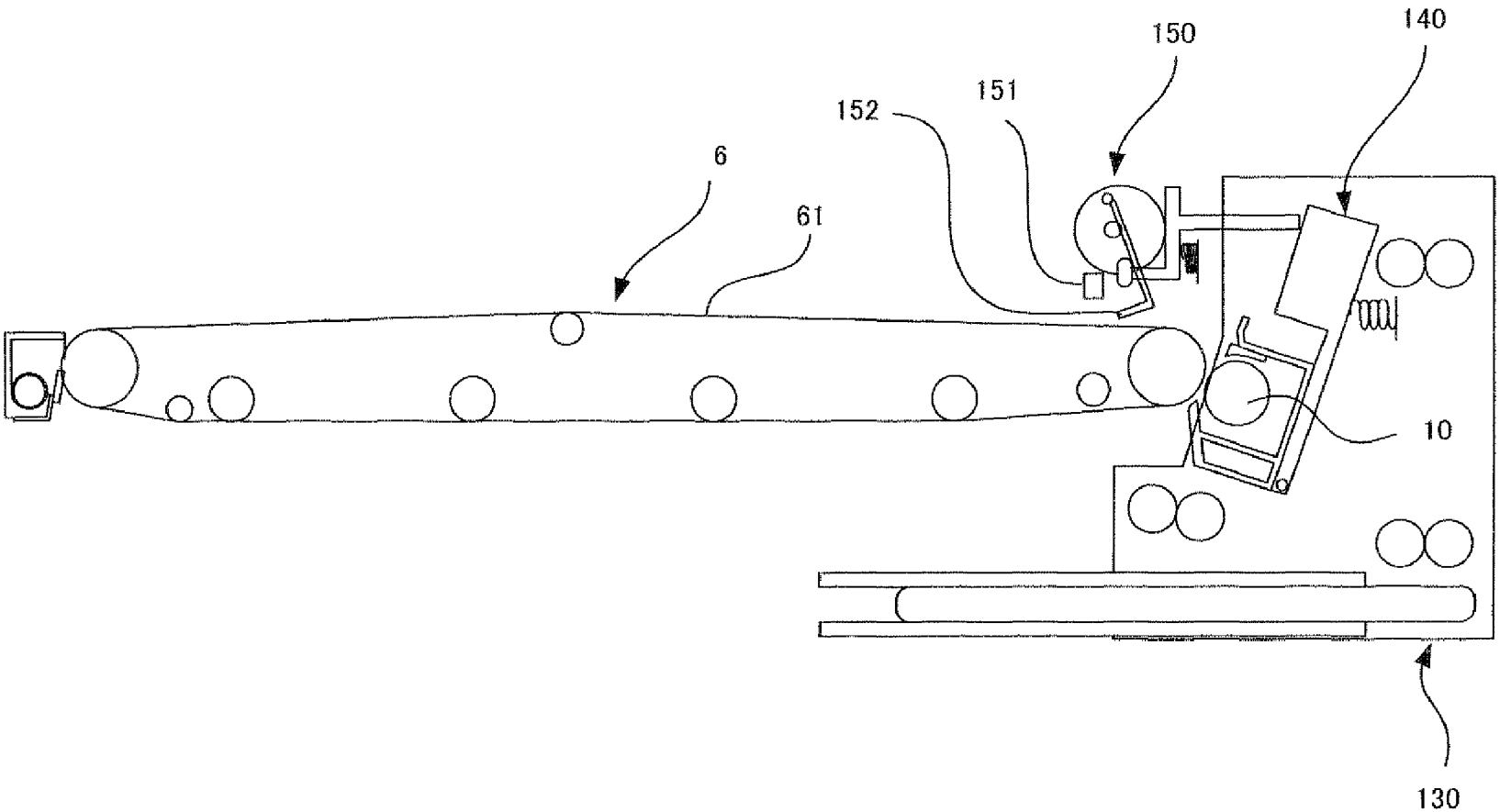
FIG. 4 is a view showing a state of a transfer portion in an image forming apparatus of the present technology when a reference toner image is being read.

FIG. 4 shows a state of a reference toner image being read. Since, in this state, the shutter 152 is opened so that the optical sensor 151 can detect the reference toner image on the transfer belt 61 surface while the transfer roller 10 is moved away from the transfer belt 61, the reference toner image formed on the transfer belt 61 can arrive at the front of the optical sensor 151 without having been rubbed by the transfer roller 10, whereby it is possible with the optical sensor 151 to detect correct density and position.

Figure 5:
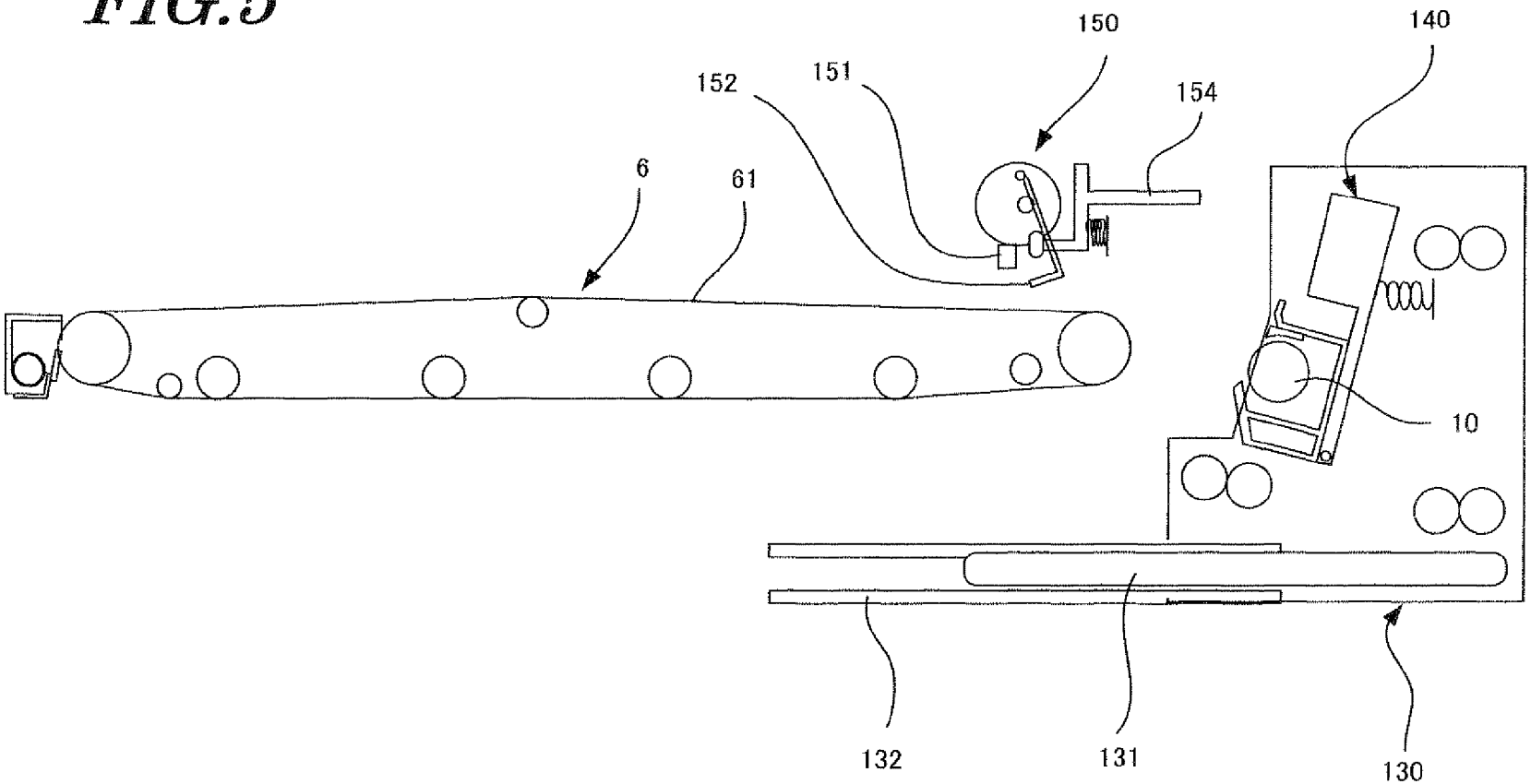
FIG. 5 is view showing a state of a transfer portion in an image forming apparatus of the present technology when a side unit is drawn out.

FIG. 5 shows a state of the side unit which is pulled out. In this state, pressure of the secondary transfer unit 140 against one end of the lever 154 is released, and the elastic force of the spring (small) 156 moves the lever 145 rightwards so as to open the shutter 152.

Since the shutter 152 is separated from the transfer belt 61 and therearound, it is possible to prevent the shutter 152 from colliding with the surface of the transfer belt 61 and damaging the transfer belt 61 when the transfer belt unit 6 is detached from and mounted to the main body (when the transfer belt unit is replaced).

Figure 6A:
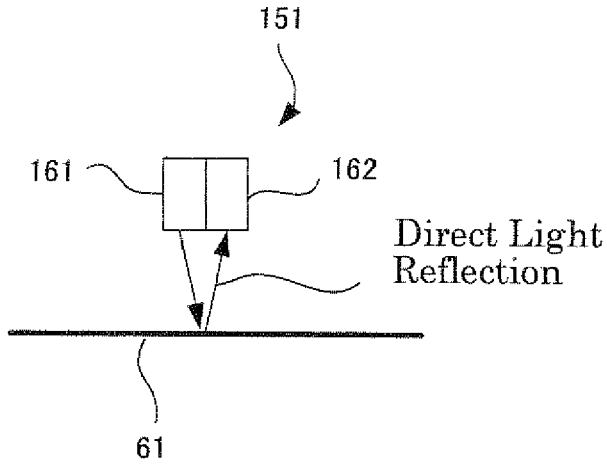
FIGS. 6A to 6C are views showing states of detection when a shutter for an optical sensor is opened and closed.
Figure 6B:
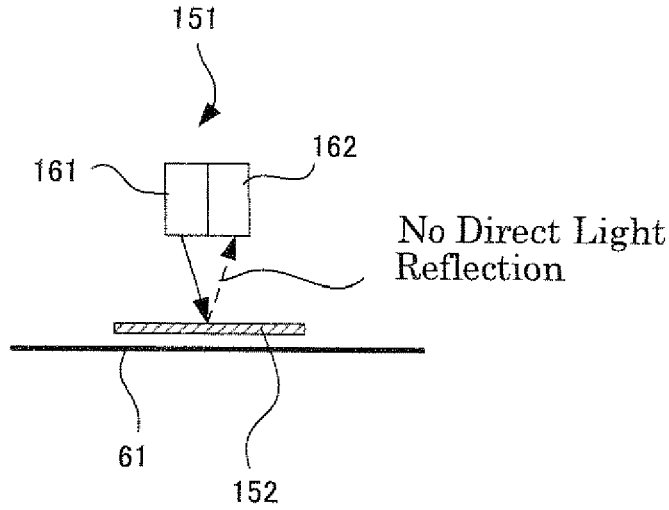
Figure 6C:
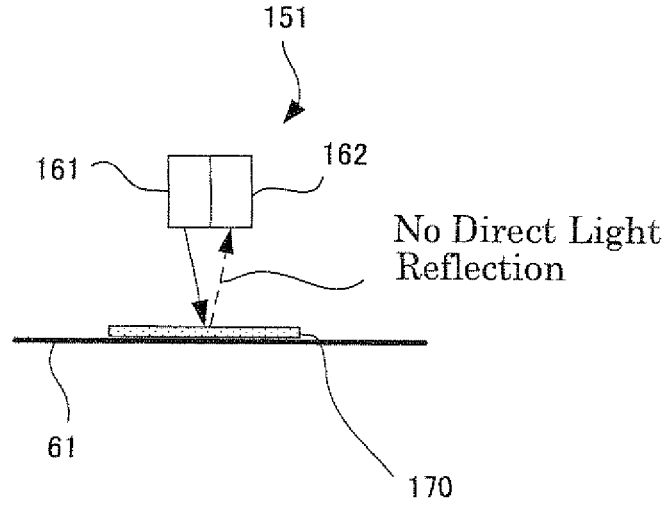

FIGS. 6A to 6C show states of detection of the optical sensor in the case where the shutter is opened and closed. FIGS. 6A and 6C show states where the shutter 152 is open. On the other hand, FIG. 6B shows a state where the shutter 152 is closed.

The optical sensor 151 includes an LED 161 and a phototransistor 162 and detects the reference toner image by emitting an infrared ray from the LED 161 onto the toner image on the transfer belt 61 while detecting the direct light reflection from the toner image by the phototransistor 162, to thereby detect the toner density and the position of the toner image.

As shown in FIG. 6A, when the shutter 152 is open, the optical sensor 151 can detect the reflected light from the transfer belt 61. When the shutter 152 is closed as shown in FIG. 6B, the optical sensor 151 cannot detect any reflected light because no direct light reflection exists. In this way, it is possible to detect open and closed states of the shutter 152.

However, if a thick toner image (solid image) exists on the transfer belt 61 as shown in FIG. 6C, no light reflection is generated, even though the shutter 152 is open. Hence the optical sensor 151 cannot detect any reflected light. As a result, even though shutter 152 is open, the sensor erroneously detects the shutter being closed. The present technology is to prevent the malfunction of the shutter due to erroneous detection of this kind.

Figure 7:
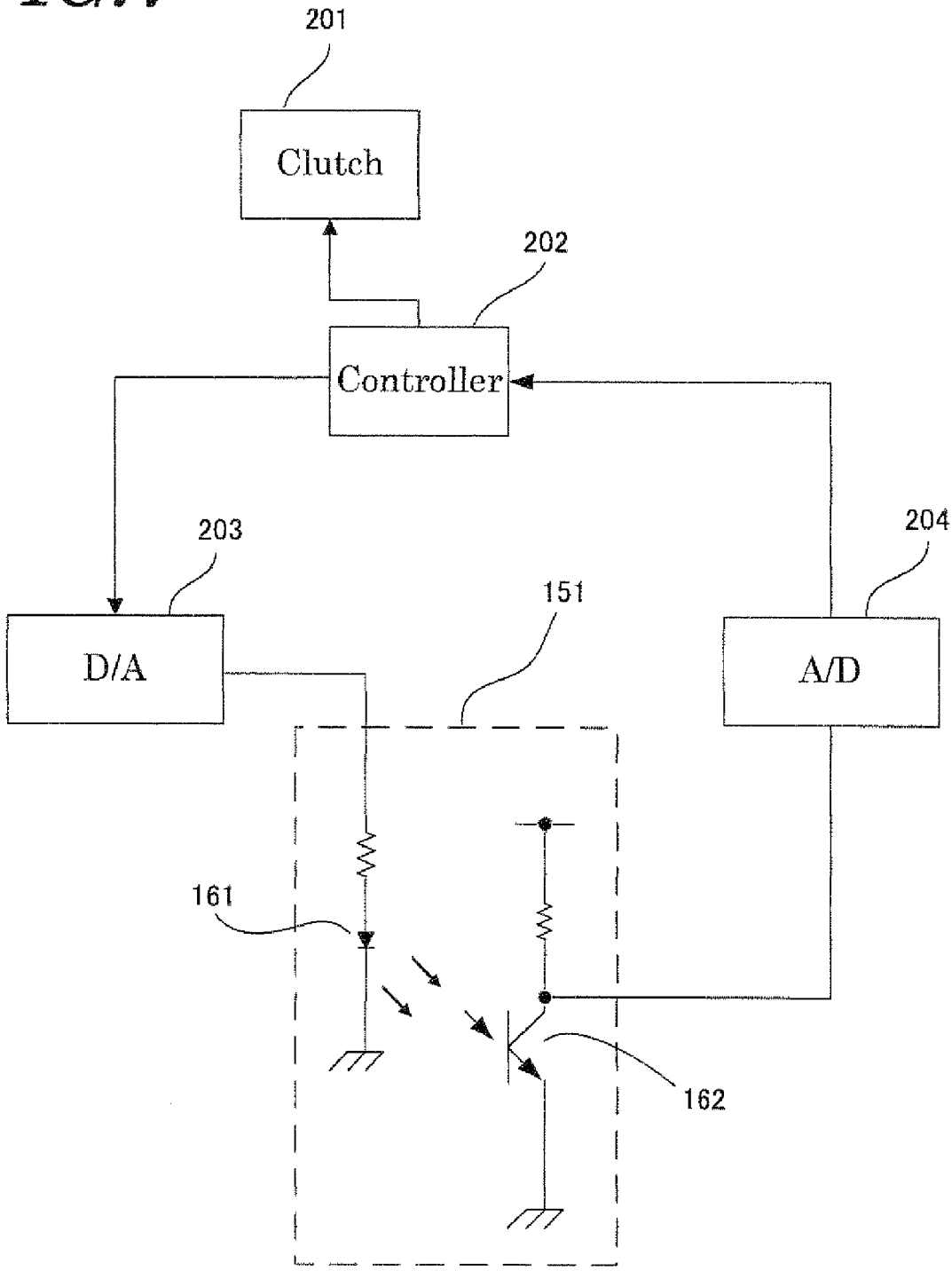
FIG. 7 is a block diagram showing an optical sensor and related components in an image forming apparatus.

FIG. 7 is a block diagram showing the optical sensor and related components in the image forming apparatus.

The light emitter is a part of the optical sensor 151, specifically, the infrared LED 161 that is driven by the output from a D/A converter 203. The light receiver is a part of the optical sensor 151, specifically, the phototransistor 162 that receives infrared rays. The A/D converter 204 converts analog values from the phototransistor 162 into digital values.

A controller 202 controls the drive of the offset cam 155 in accordance with the output from the optical sensor 151. The offset cam 155 is coupled with a motor as a drive source via a clutch 201. This offset cam 155 rotates when the clutch is turned "ON".

Here, no separate drive motor for the drive source is needed by making use of the drive motor for the fusing roller.

Figure 8:
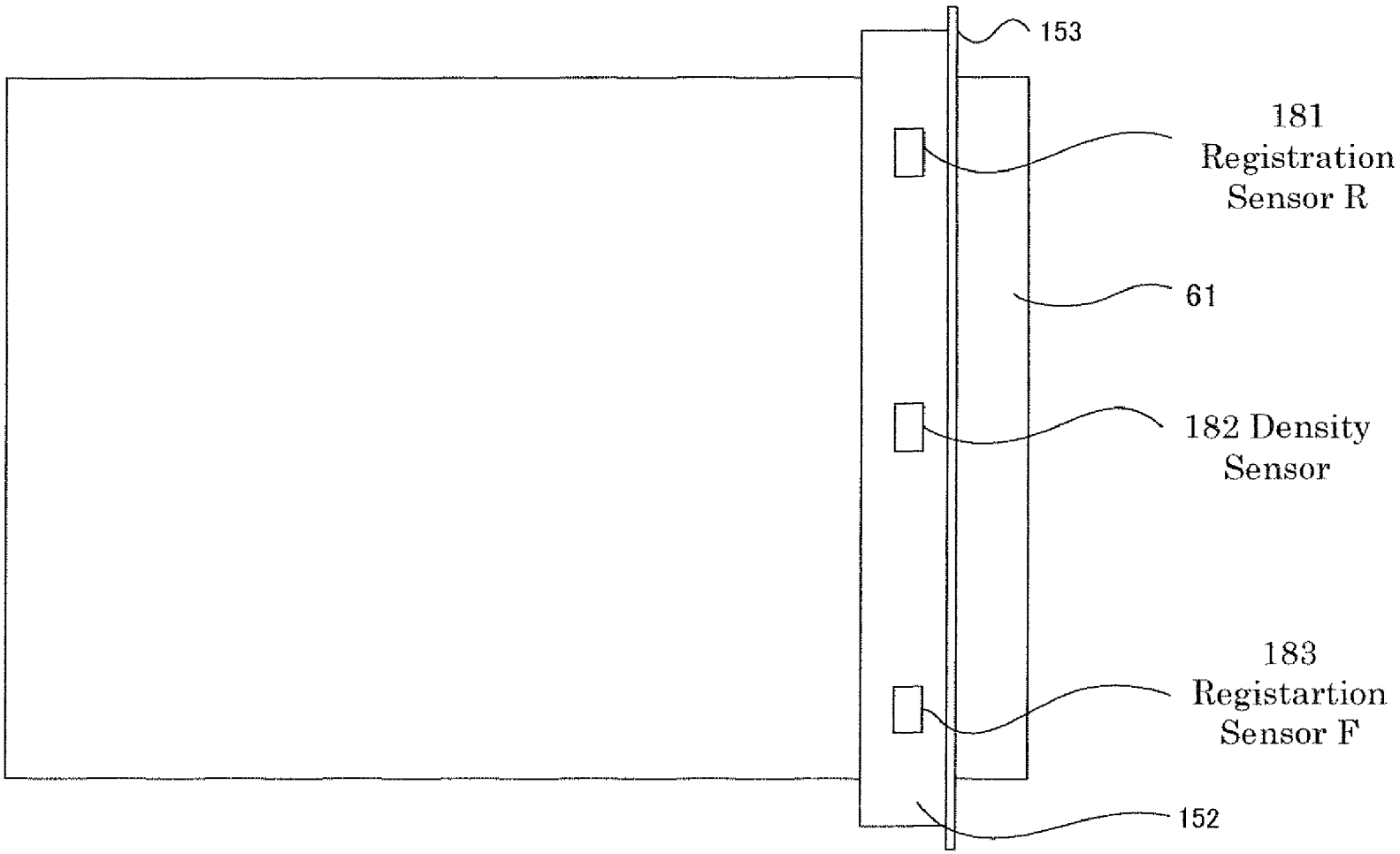
FIG. 8 is a view showing an arrangement of a transfer belt, a density sensor and registration sensors, viewed from the top of the apparatus.

FIG. 8 shows an arrangement of the transfer belt, density sensor and registration sensors, viewed from the top of the apparatus.

A pair of registration sensors 181 and 183 (registration sensors F and R) are provided at the front side and rear side of the apparatus in order to measure the image forming position by detecting the second reference toner image and make correction to the image forming position. A density sensor 182 is disposed between registration sensors 181 and 183. The density sensor 182 and the registration sensors 181 and 183 are laid out in a row in the main scan direction, and detected surfaces are shielded and opened by the common shutter 152. Accordingly, the multiple optical sensors can be handled with only one set of the shutter 152 and the open-and-closed mechanism, it is hence possible to avoid parts increasing in number.

Figure 9:
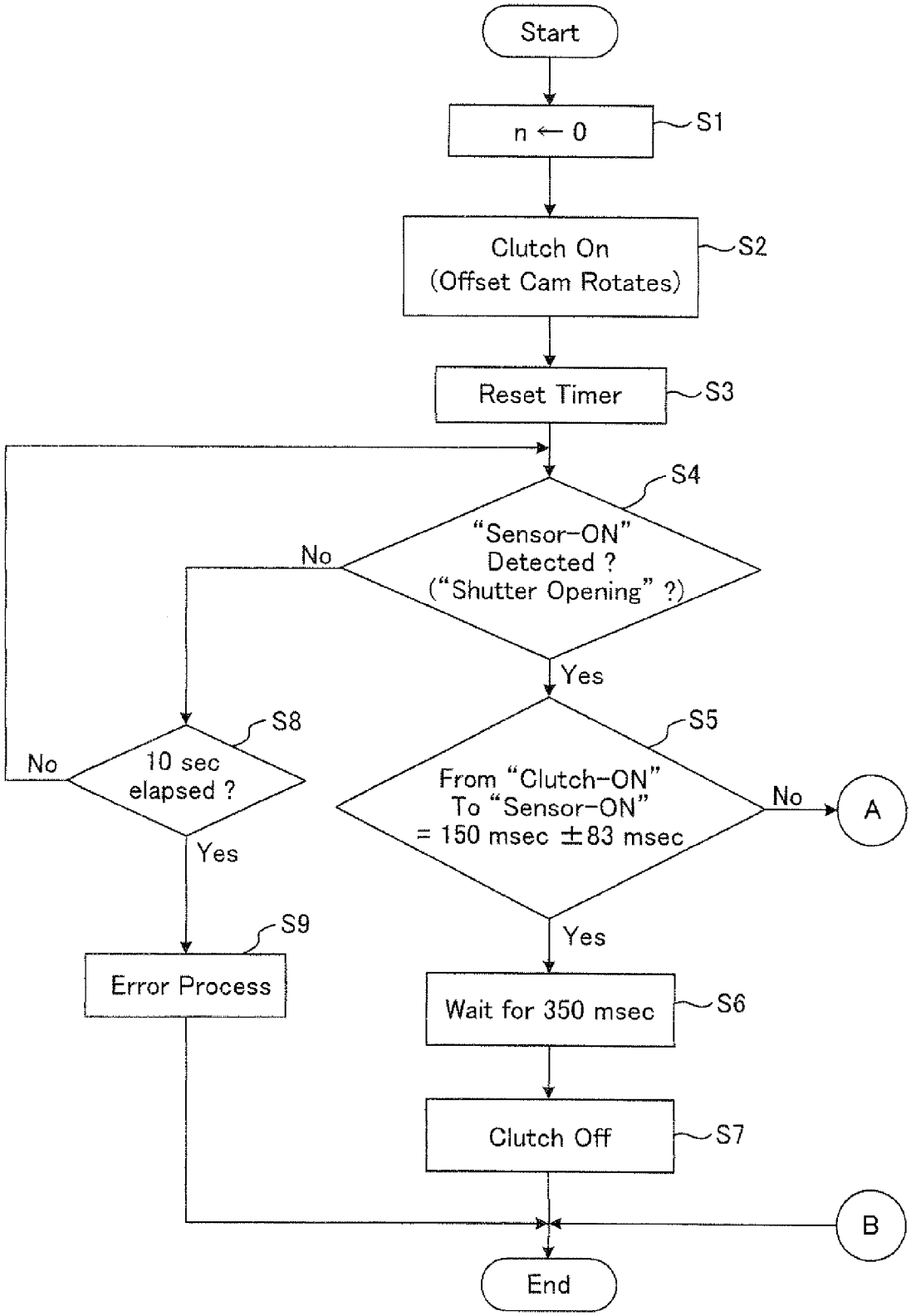
FIG. 9 is a flow chart showing "closed-to-open" control of a shutter.
Figure 10:
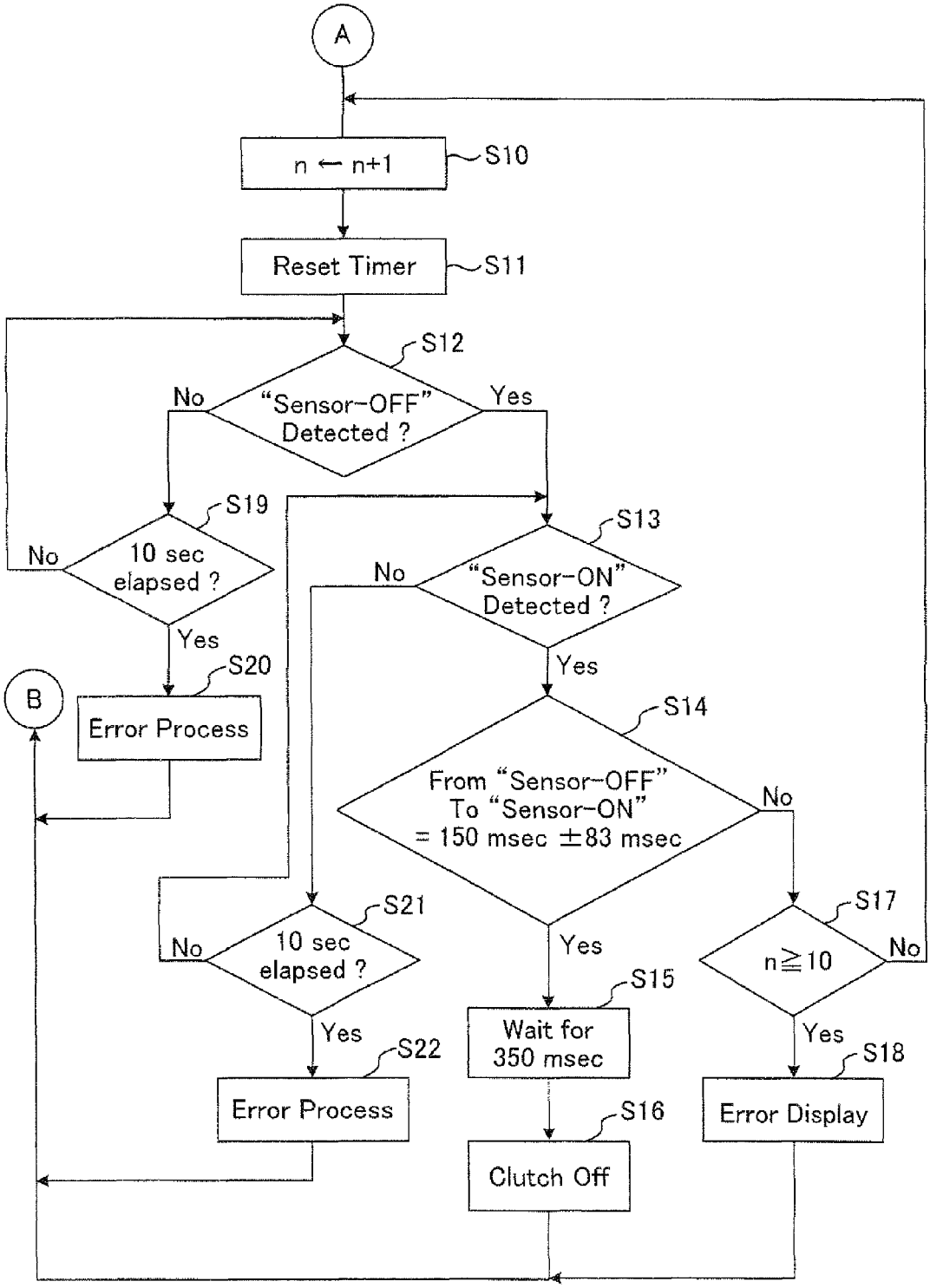
FIG. 10 is a flow chart showing "closed-to-open" control of a shutter.

FIGS. 9 and 10 show a "shutter closed-to-open" control flow. This flow is executed by the controller 202.

A counter n is input with 0 (Step S1). The counter n counts the number of times the shutter 152 has performed "closed-to-open" operations. The clutch 201 is turned "ON" to start the offset cam 155 rotating (Step S2). A timer is reset (Step S3) and the control is waited until "sensor-ON" (that indicates the shutter being opened) is detected (Step S4). When "sensor-ON" is detected (Step S4; Yes), it is determined whether time from "clutch-ON" to "sensor-ON" falls within the range of 150 msec±83 msec (Step S5). If the time falls within that range, the operation is normal (Step S5; Yes), and another 350 msec is waited for (Step S6), then the clutch is turned off (Step S7) to end the operation.

Figure 11A:
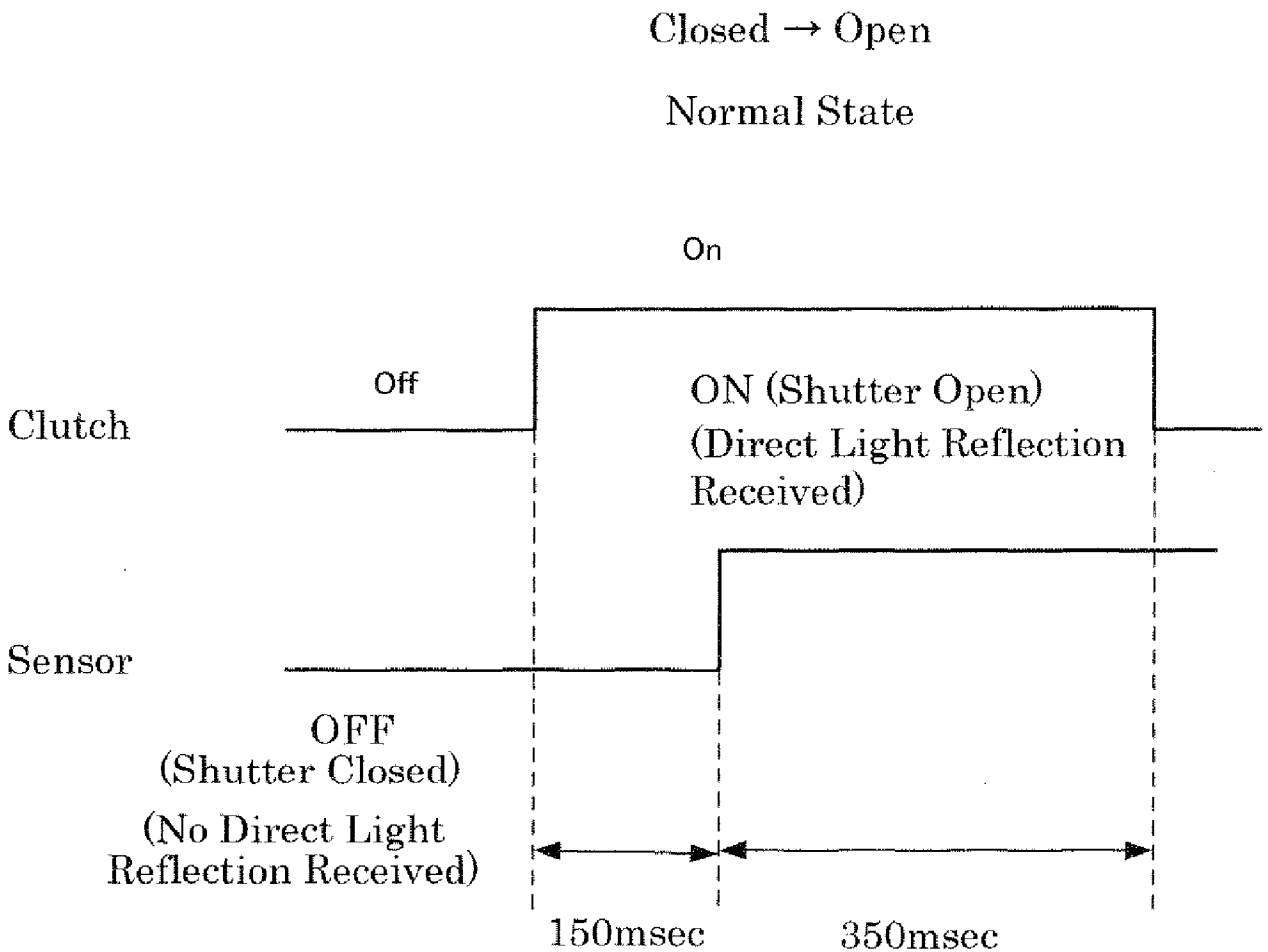
FIGS. 11A and 11B show time charts for sensor output and clutch control when "closed-to-open" control of a shutter is performed under a normal condition and under an anormal condition, respectively.
Figure 11B:
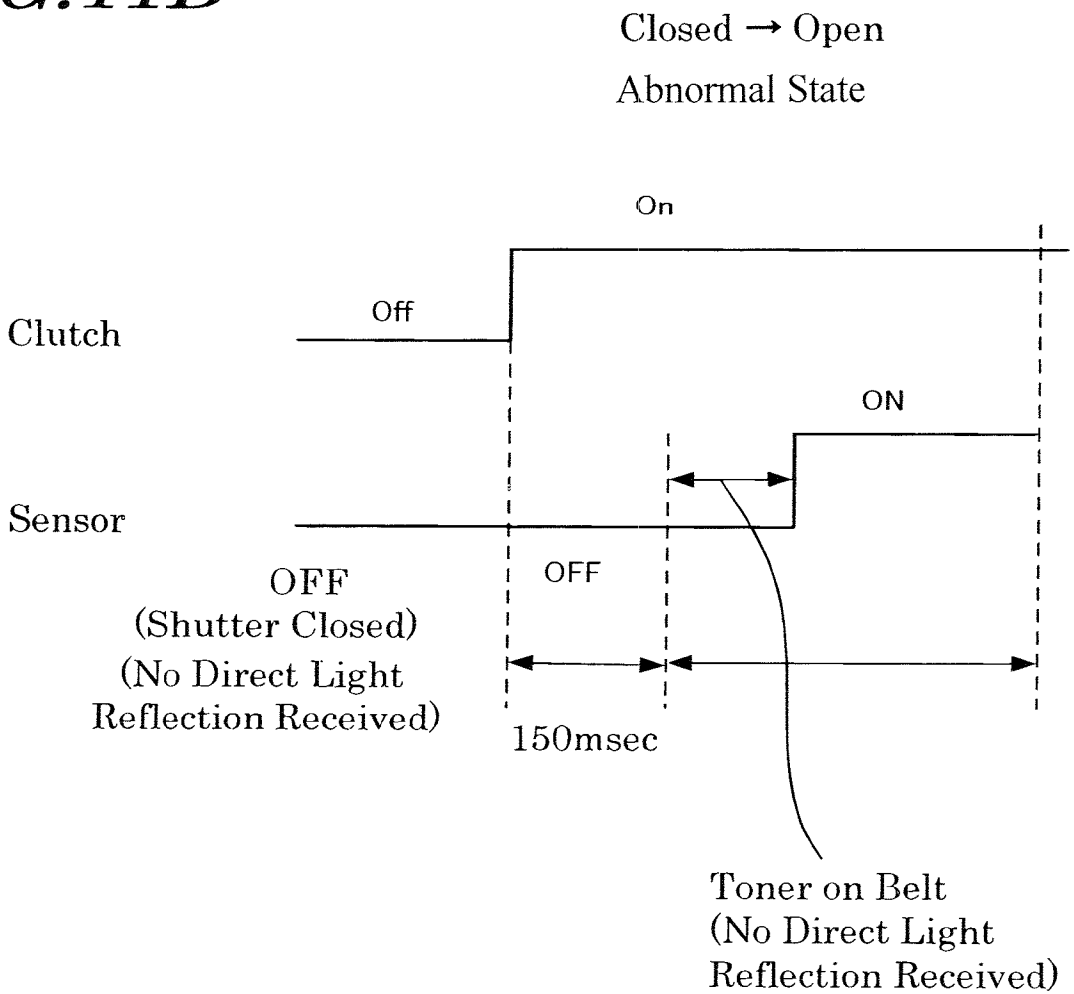

FIGS. 11A and 11B show time charts for sensor output and clutch control when "closed-to-open" control is performed under a normal condition and under an anormal condition, respectively. These time charts show the criteria for determination at Step S5.

Figure 13:
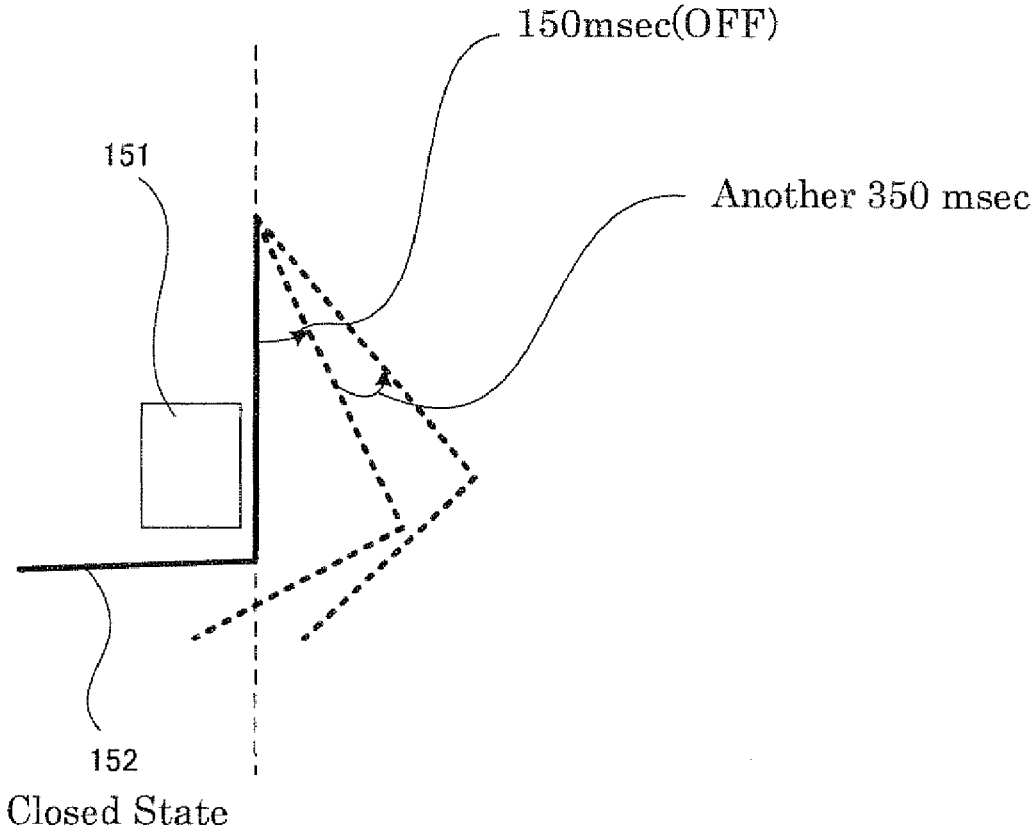
FIG. 13 is a view showing the positional angles of the shutter in "closed-to-open" control.

First, under a normal condition, time from "clutch-ON" to "sensor-ON" is within 150 msec±83 msec, as stated above. As shown in FIG. 13, this time corresponds to the time taken for the shutter 152 to move from the closed state to the state where the shutter 152 is released or moved to the position that permits the optical sensor 151 to perform detection. Since, in this condition, the shutter 152 has not fully opened yet, detection of the reference toner image is started after a lapse of another 350 msec so that shutter 152 can be fully opened as shown in FIG. 13.

In the anormal condition in FIG. 11B, since the adherence of toner exists on the transfer belt 61 at the position being detected by the optical sensor, no reflected light can be detected even after a lapse of 150 msec±83 msec. Then, when the adherence of toner has moved away from the position of detection as the transfer belt 61 moves, the reflected light will be able to be detected. Accordingly, the controller 202 determines that there is an anomaly if the optical sensor cannot detect the reflected light within the range of 150 msec±83 msec.

When no reflected light can be detected within the predetermined time range for detection at Step S5 (Step S5; No), the counter n is incremented by 1 (Step S10) and the timer is reset (Step S11). Then, the control is waited until "sensor-OFF" (the shutter closed) is detected (Step S12; Yes).

Further, the control is waited until detection of "sensor-ON" (the shutter open). When "sensor-ON" is detected (Step S13; Yes), it is determined whether the operation is normal (Step S14). That is, it is checked whether time from "sensor-OFF" to "sensor-ON" falls within the range of 150 msec±83 msec. When the operation is normal (Step S14; Yes), another 350 msec is waited for (Step S15), then the clutch is turned off (Step S16) to end the operation.

At Step S14, when time from "sensor-OFF" to "sensor-ON" falls beyond the range (No), the operation is not normal, hence it is determined if n is equal to or greater than 10 (Step S17). If the counter n is equal to or greater than 10 (Step S17; Yes), an error indication is given to end the operation (Step S18). When the counter n is not equal to or greater than 10 (Step S17; No), the control goes back to Step S10 and repeats the same operation.

Figure 12:
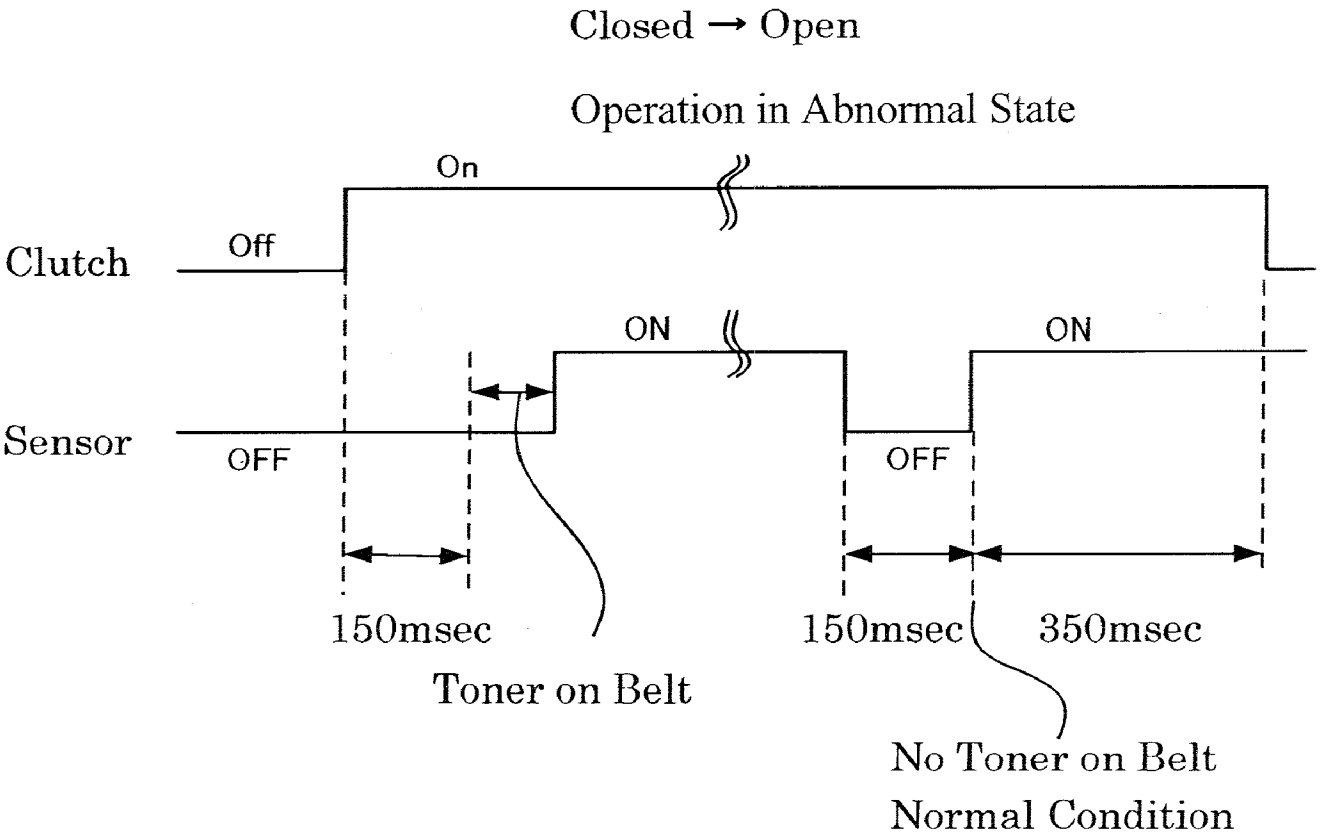
FIG. 12 is a time chart showing sensor output and clutch control in the case where control is performed following the above flow when an anormal output has occurred in the "closed-to-open" control of the shutter.

FIG. 12 shows a time chart for sensor output and clutch control in the case where the above flow control is performed when an anormal output has occurred in the "closed-to-open" control.

Similarly to FIG. 11B, since the adherence of toner exists on the transfer belt 61 at the position detected by the optical sensor, no reflected light can be detected even after a lapse of 150 msec±83 msec. Hence, this operation is determined to be anormal at Step S14, and the control returns to Step S10 and is started over again. Then, the adherence of toner is conveyed away as the transfer belt 61 moves, and optical sensor 151 detects the reflected light in a normal condition.

This loop will be repeated a number of times until the normal state is restored. However, if the loop has been repeated 10 times or greater, the detecting operation is determined to be totally impossible and an error indication is given at Step S17.

At Steps S4, S12 and S13, the control is in a state of loop where, after the timer is reset at Step S3 or S11, another change of the output from the sensor is waited. When no output change takes place after a lapse of 10 sec from timer reset (Step S8, S19 or S21; Yes), an error indication is given to end the operation (Steps S9, S20 and S22).

Figure 14:
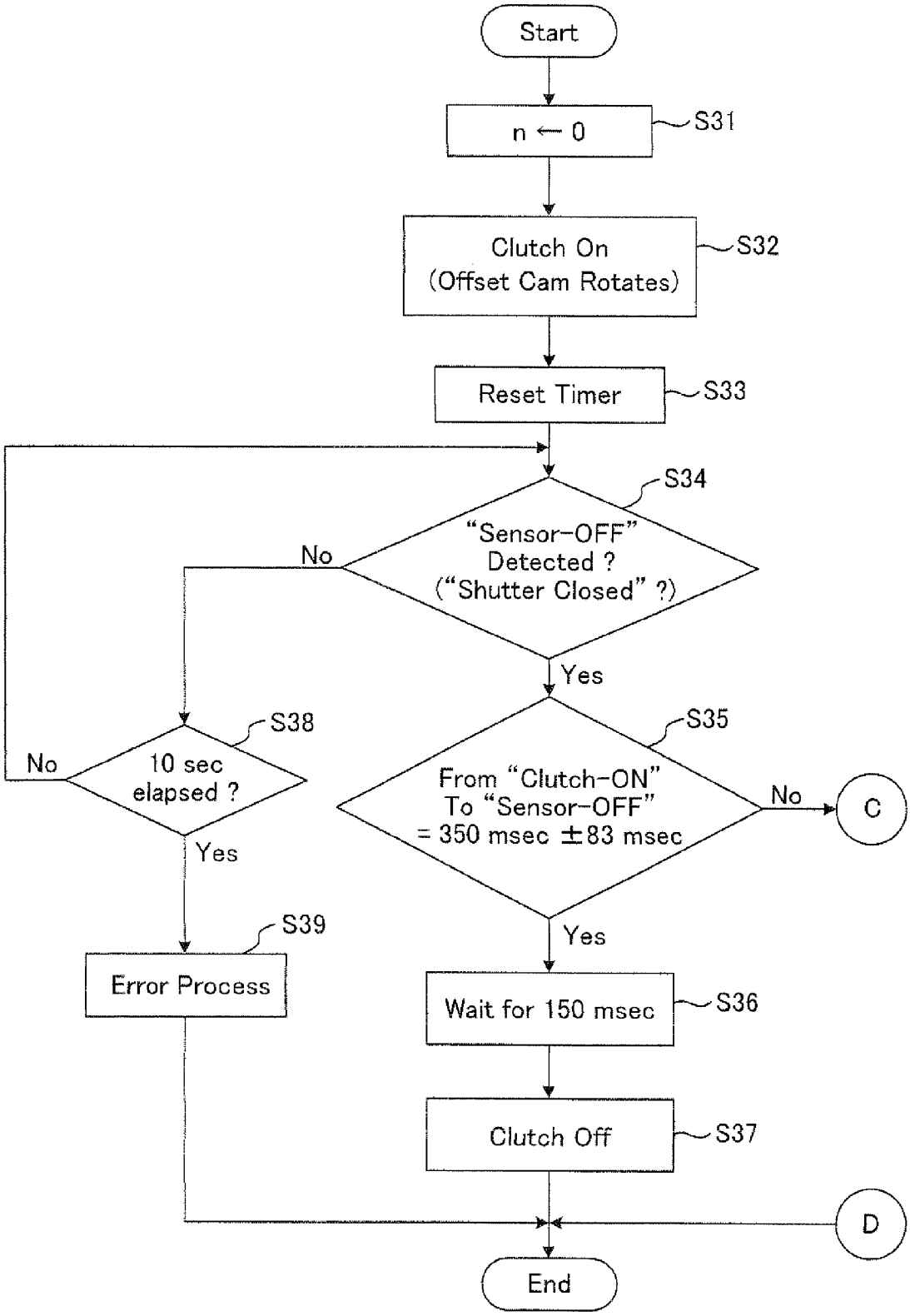
FIG. 14 is a flow chart showing "open-to-closed" control of a shutter.
Figure 15:
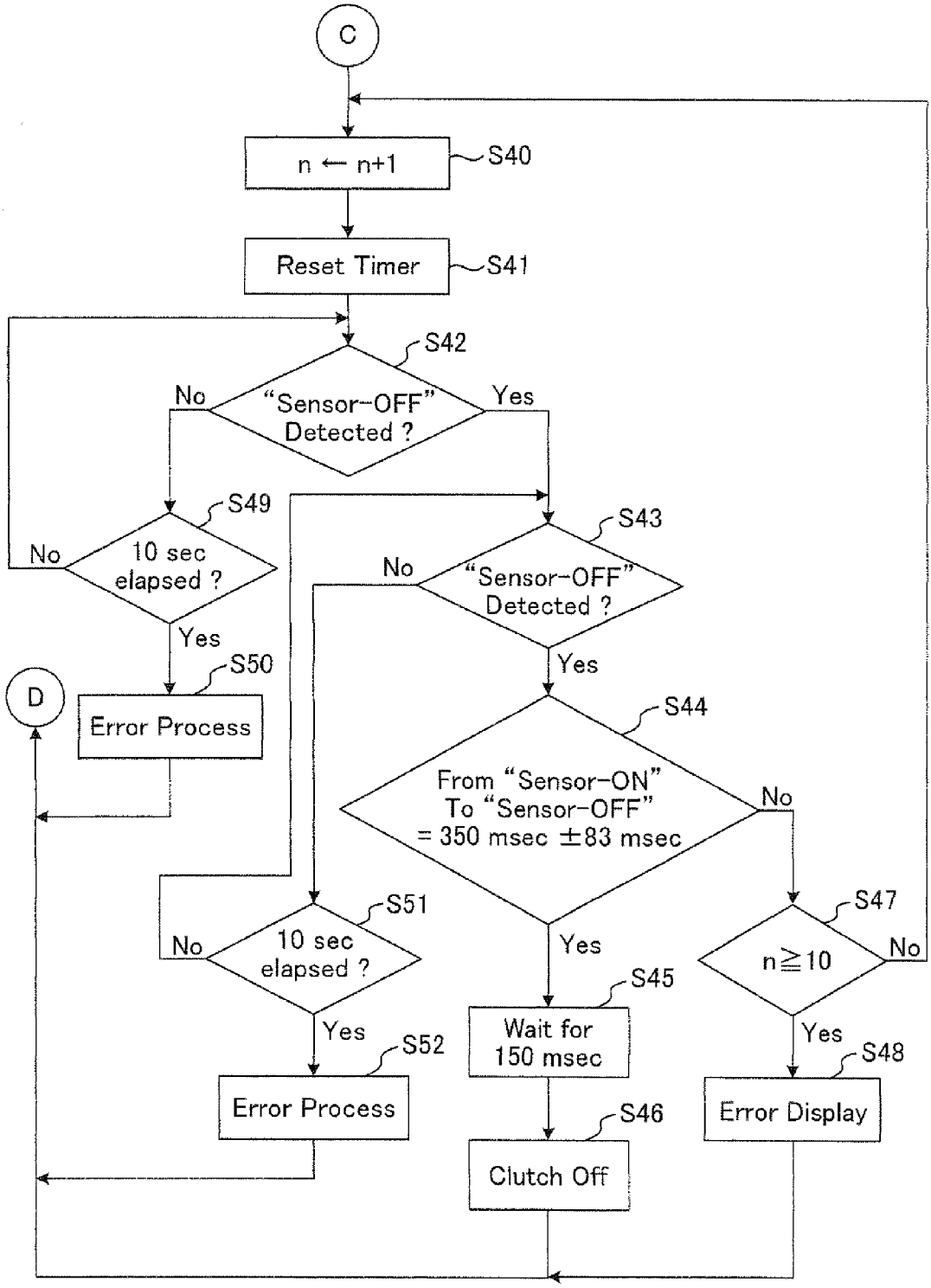
FIG. 15 is a flowchart showing "open-to-closed" control of a shutter.

Next, FIGS. 14 and 15 show a "shutter open-to-closed" control flow. This flow is executed by the controller 202.

The counter n is input with 0 (Step S31). The counter n counts the number of times the shutter 152 has performed "open-to-closed" operations. The clutch 201 is turned "ON" to start the offset cam 155 rotating (Step S32). A timer is reset (Step S33) and the control is waited until "sensor-OFF" (that indicates the shutter being closed) is detected (Step S34). When "sensor-OFF" is detected (Step S34; Yes), it is determined whether time from "clutch-ON" to "sensor-OFF" falls within the range of 350 msec±83 msec (Step S35). Then the time falls within that range, the operation is determined to be normal (Step S35; Yes), and another 150 msec is waited for (Step S36), then the clutch is turned off (Step S37) to end the operation.

Figure 16A:
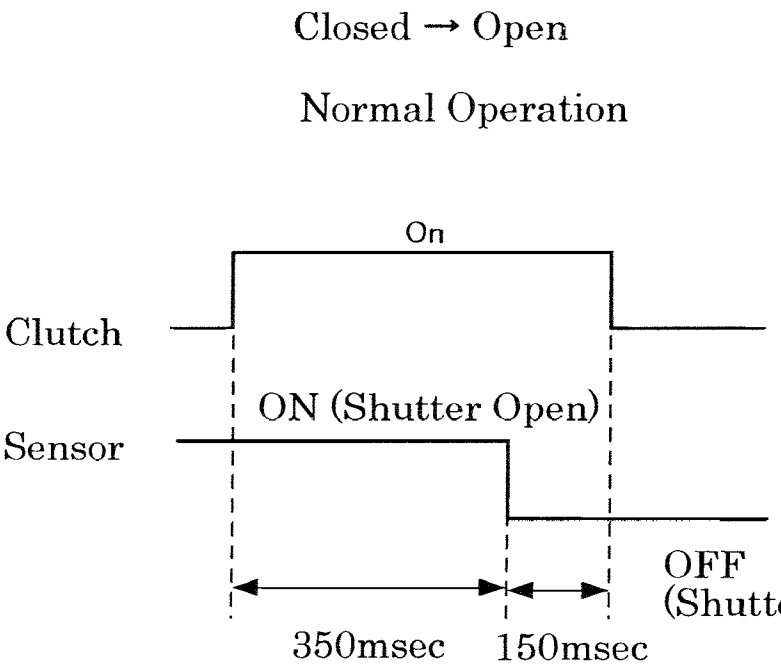
FIGS. 16A and 16B are time charts for sensor output and clutch control when "open-to-closed" control of a shutter is performed under a normal condition and under an anormal condition, respectively.
Figure 16B:
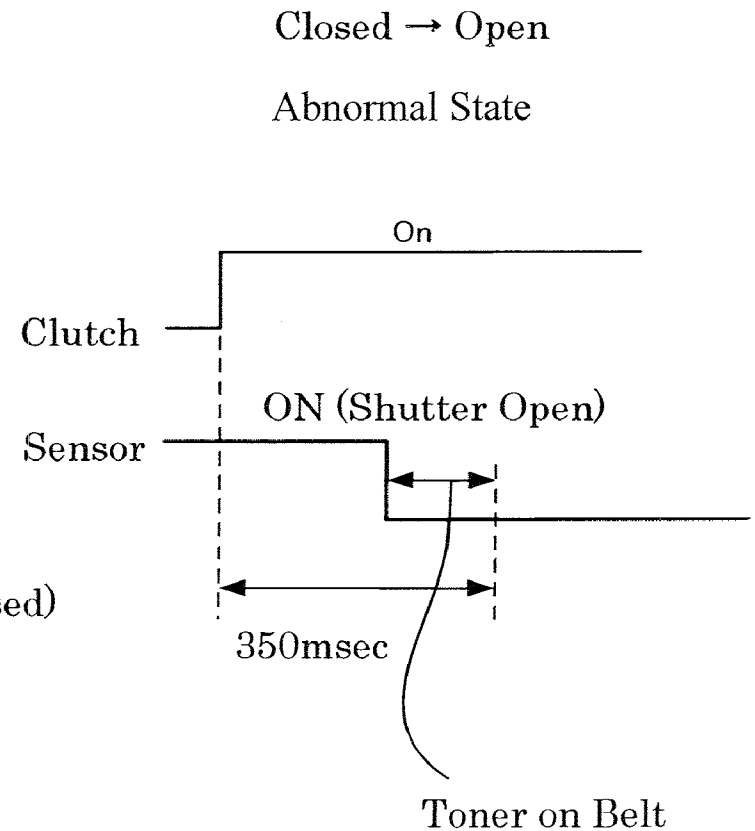

FIGS. 16A and 16B show time charts for sensor output and clutch control when "open-to-closed" control is performed under a normal condition and under an anormal condition, respectively. These time charts show the criteria for determination at Step S35.

First, under a normal condition, time from "clutch-ON" to "sensor-OFF" is within 350 msec±83 msec, as stated above.

Figure 18:
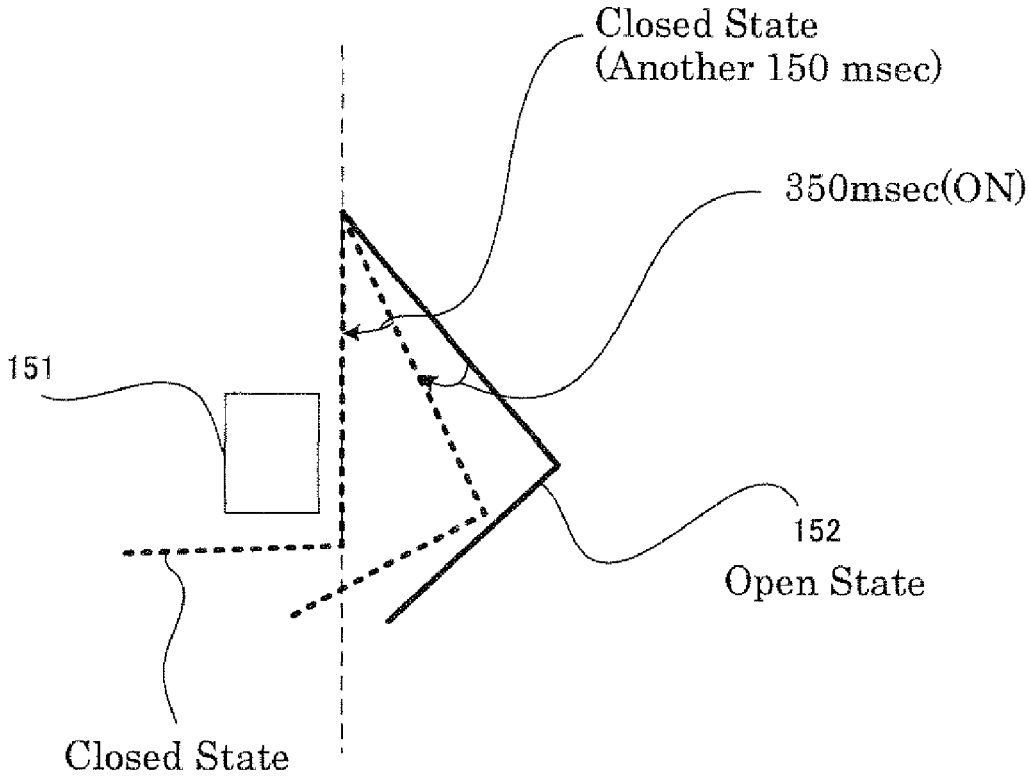
FIG. 18 is a view showing the positional angles of the shutter in "open-to-closed" control.

As shown in FIG. 18, this time corresponds to the time taken for the shutter 152 to move from the open state to the boundary position at which detection by the optical sensor 151 is permitted. Since, in this condition, the shutter 152 has not been fully closed yet, another 150 msec is waited for so as to fully close the shutter 152 as shown in FIG. 18. Then, the clutch 201 is turned off.

In an anormal condition in FIG. 16B, since the adherence of toner exists on the transfer belt 61 at the position detected by the optical sensor, the reflected light becomes unable to be detected before a lapse of 350 msec±83 msec passes. Accordingly, the controller 202 determines that there is an anomaly if the optical sensor has become unable to detect reflected light before a lapse of 350 msec±83 msec.

When no reflected light can be detected before a lapse of the predetermined time at Step S35 (Step S35; No), the counter n is incremented by 1 (Step S40) and the timer is reset (Step S41). Then, the control is waited until "sensor-ON" (the shutter open) is detected (Step S42; Yes). The control is waited until "sensor-OFF" (the shutter closed). When "sensor-OFF" is detected (Step S43; Yes), it is determined whether the operation is normal (Step S44). That is, it is checked whether time from "sensor-ON" to "sensor-OFF" falls with the range of 350 msec±83 msec. When the operation is normal (Step S44; Yes), another 150 msec is waited for (Step S45), then the clutch is turned off (Step S46) to end the operation.

At Step S44, when time from "sensor-ON" to "sensor-OFF" falls beyond the range (No), the operation is determined not to be normal, hence it is determined if the counter n is equal to or greater than 10 (Step S47). If the counter n is equal to or greater than 10 (Step S47; Yes), an error indication is given to end the operation (Step S48). When the counter n is not equal to or greater than 10 (Step S47; No), the control goes back to Step S40 and repeats the same operation.

Figure 17:
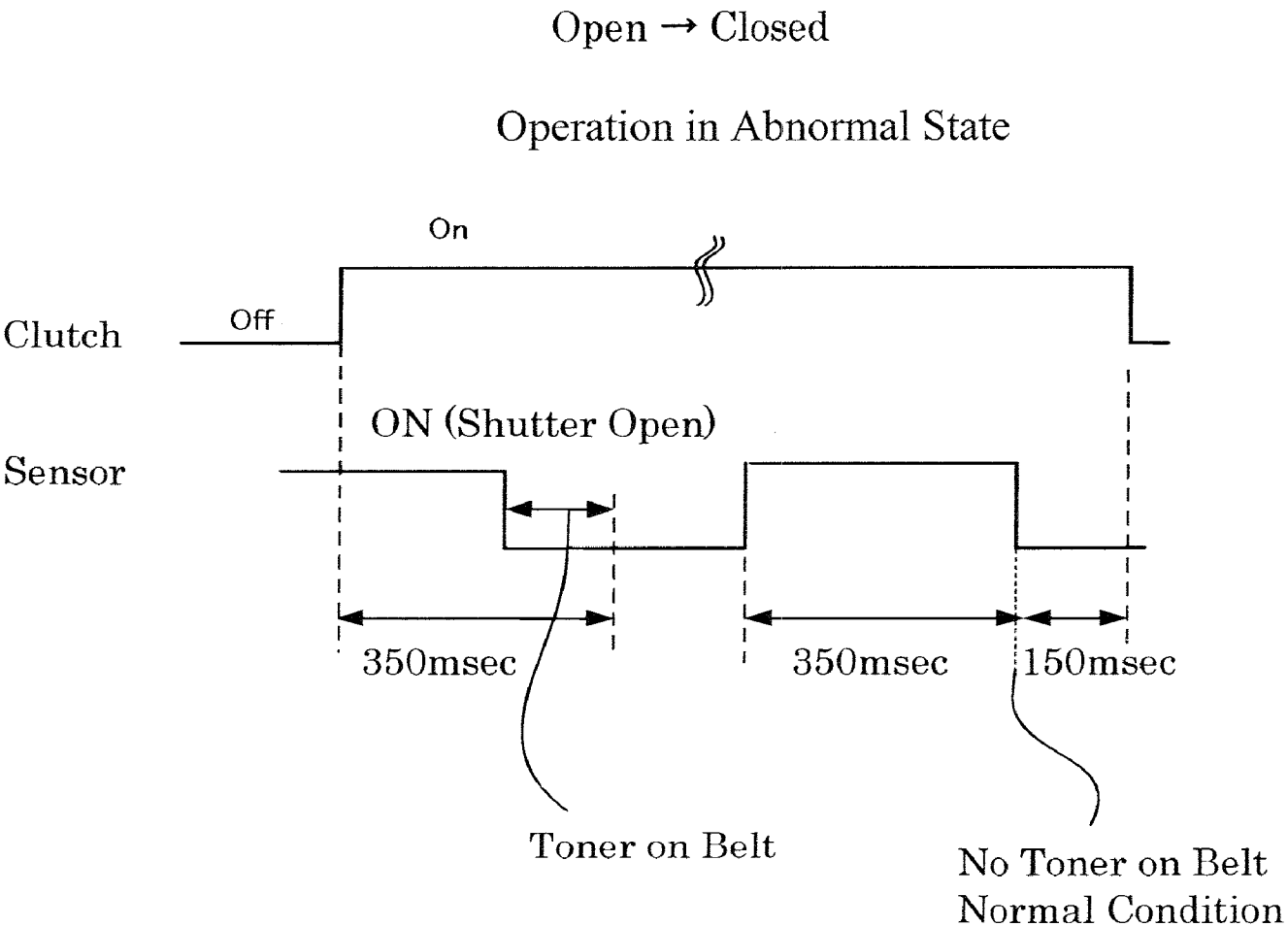
FIG. 17 is a time chart showing sensor output and clutch control in the case where control is performed following the above flow when an anormal output has occurred in the "open-to-closed" control of the shutter.

FIG. 17 shows a time chart for sensor output and clutch control in the case where the above flow control is performed following when an anormal output has occurred in the "open-to-closed" control.

Similarly to FIG. 16B, since the adherence of toner exists on the transfer belt 61 at the position detected by the optical sensor, the optical sensor becomes unable to detect the reflected light before 350 msec±83 msec elapses. Hence, the operation is determined to be anormal at Step S44, and the control returns to Step S40 and is started over again.

Then, the adherence of toner is conveyed away as the transfer belt 61 moves, and the sensor turns "OFF" in a normal condition (after a lapse of 350 msec±83 msec).

This loop will be repeated a number of times until the normal state is restored. However, if the loop has been repeated 10 times or greater, it is determined that the detecting operation is totally abnormal and an error indication is given at Step S47.

At Steps S34, S42 and S43, the control is in a state of loop where, after the timer is reset at Step S33 or S41, another change of the output from the sensor is waited. When no output change takes place after a lapse of 10 sec from timer reset (Step S38, S49 or S51; Yes), an error indication is given to end the operation (Steps S39, S50 and S52).

In the above way, in the image forming apparatus of the present technology, when the opening or closing of the shutter is detected based on the output of the optical sensor, it is possible to identify erroneous detection based on the toner on the transfer belt and thereby prevent the occurrence of the malfunction of the open-and-closed control of the shutter.

Next, a cleaning member and a separation/contact assembly that characterize the present technology will be described.

As shown at Step S9 in FIG. 9, Steps S20, S22 and S18 in FIG. 10, Step S39 in FIG. 14, Steps S50, S52 and S48 in FIG. 15, when no reflected light has been detected for the predetermined period of time or greater or within the particular time range, an error indication is displayed. This error will occur when a toner has adhered to a wide area on the transfer belt 61, except when there is an anomaly in the operation of the shutter open-and-closed mechanism.

In the present technology, in order to prevent the occurrence of an error even when a wide area of toner adherence on the transfer belt 61 has occurred, a cleaning member that moves into and out of contact with the surface of the transfer belt in linkage with the open-and-closed movement of the shutter 152 shown in FIGS. 3A and 3B is provided. The cleaning member is adapted to clean the surface of the transfer belt when the shutter is closed and move away from the transfer belt when the shutter is open, so that the clean surface of the transfer belt can be constantly detected.

On the other hand, when the test pattern image (reference toner image) for checking whether the image forming process is carried out correctly is to be detected, in order to avoid the test pattern image being cleaned the opening and closing timing is controlled so that the cleaning member will be moved away from the transfer belt by the time when the transfer belt is conveyed to the position where the test pattern image is cleaned by the cleaning member.

Figure 19A:
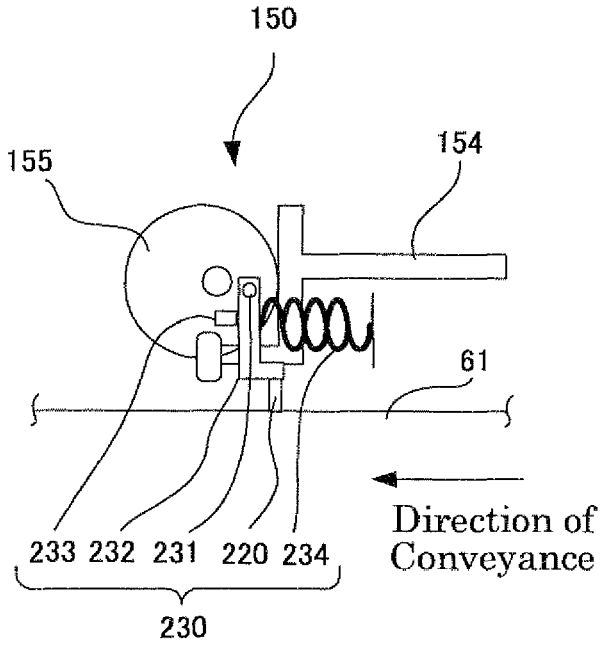
FIGS. 19A and 19B are views showing the configuration and operation of a cleaning member and a separation/contact assembly provided for an optical sensor unit.
Figure 19B:
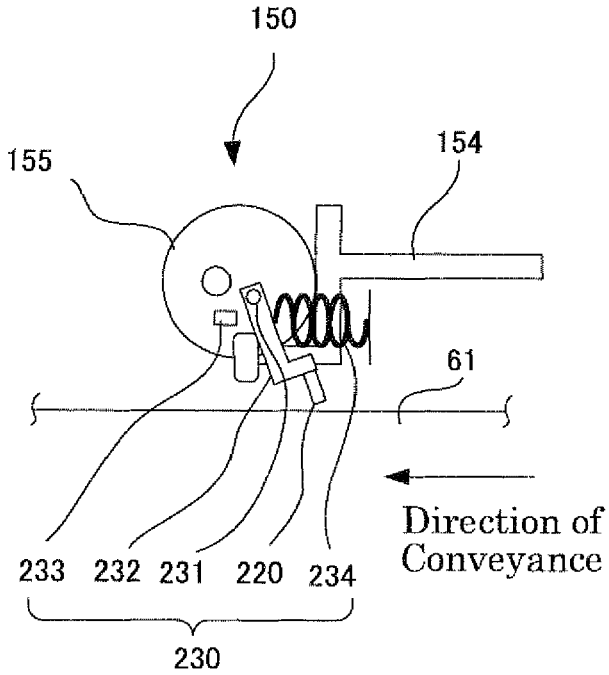

FIGS. 19A and 19B show the configuration and operation of a cleaning member 220 and a separation/contact assembly provided for the optical sensor unit 150. The cleaning member 220 and separation/contact assembly 230 will be described in detail referring to FIGS. 19A and 19B.

The cleaning member 220 cleans the transfer belt surface, located on the upstream side, with respect to the transfer belt's direction of conveyance, of the detecting surface of optical sensor 151. The separation/contact assembly 230 moves cleaning member 220 into and out of contact with the transfer belt surface in linkage with the opening and closing of the shutter 152.

The configuration of the cleaning member 220 and separation/contact assembly 230 will be described.

The clearing member 220 is a resin-formed plate-like blade or brush.

The separation/contact assembly 230 for moving cleaning member into and out of contact is comprised of an arm 232 rotationally supported on a pivot 231, an abutment part 233 fixed to the body frame so as to limit the rotation of the arm 232 and a spring 234 for pressing the arm 232 in the clockwise direction. The cleaning member 220 is attached at the distal end of the arm 232.

The operation of cleaning member 220 and separation/contact assembly 230 will be described.

As shown in FIG. 19A, while the shutter 152 is being closed, the distal end of lever 154 is kept away from the arm 232. Accordingly, the arm 232 is urged clockwise by the sprint 234 and stopped at the position of the abutment part 233 so that the cleaning member 220 contacts and cleans the transfer belt 61 surface.

As shown in FIG. 19B, while shutter 152 is open, the distal end of the lever 154 comes into contact with the arm 232 and rotates the arm 232 counterclockwise, opposing the urging force of the spring 234. Accordingly, the cleaning member 220 is separated from the surface of the transfer belt 61 so that the surface of the transfer belt can be detected by the sensor 151.

Figure 20:
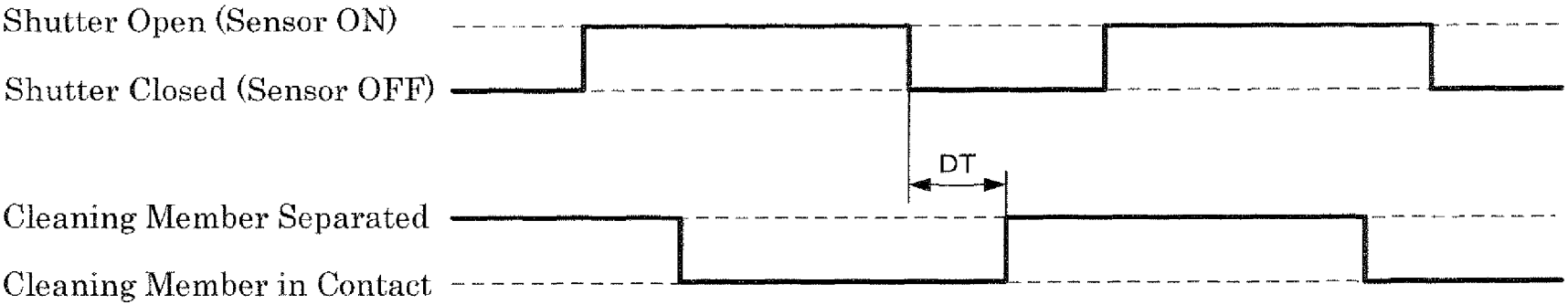
FIG. 20 is a timing chart for illustrating the opening and closing of a shutter and the contact and separation of a cleaning member; and, FIG. 21 is a view showing a cleaning member and a transfer belt from top.

It should be noted that a delay time DT is given from the time when the shutter 152 is closed so as to make the reflected light from transfer belt 61 undetectable by optical sensor 151 to the time when the cleaning member 220 moves away from the transfer belt 61. The controller 202 detects whether or not the shutter operates correctly, based on the timing at which the shutter 152 opens and the reflected light from the transfer belt 61 is detected by the optical sensor 151. This delay time DT needs to be set such that the cleaning member 61 is moved away before the shutter opens so as not to clean the test pattern image while the area cleaned by the cleaning member can be detected when the shutter opens and the sensor starts detection (see FIG. 20). Specifically, the delay time DT is set at 100 to 200 ms.

When the test pattern image has been transferred to the transfer belt 61 by the secondary transfer unit 140, the controller 202 opens the shutter 152 and moves the cleaning member 220 away by the time when the transfer belt 61 is conveyed to the position where the test pattern image is cleaned by the cleaning member 220. That is, the controller 202 determines the time taken for the test pattern image to reach the cleaning position from the conveying speed of the transfer belt 61, takes the thus calculated time and the delay time DT for separation of the cleaning member 220 into account, thereby opening the shutter 152 at the timing when the cleaning member 220 moves away from the transfer belt 61 before the arrival of the test pattern image. In this way, it is possible to check whether the image forming process is correctly carried out based on the test pattern image without the test pattern image being cleaned by the cleaning member 220 provided for the optical sensor unit 150.

Figure 21:
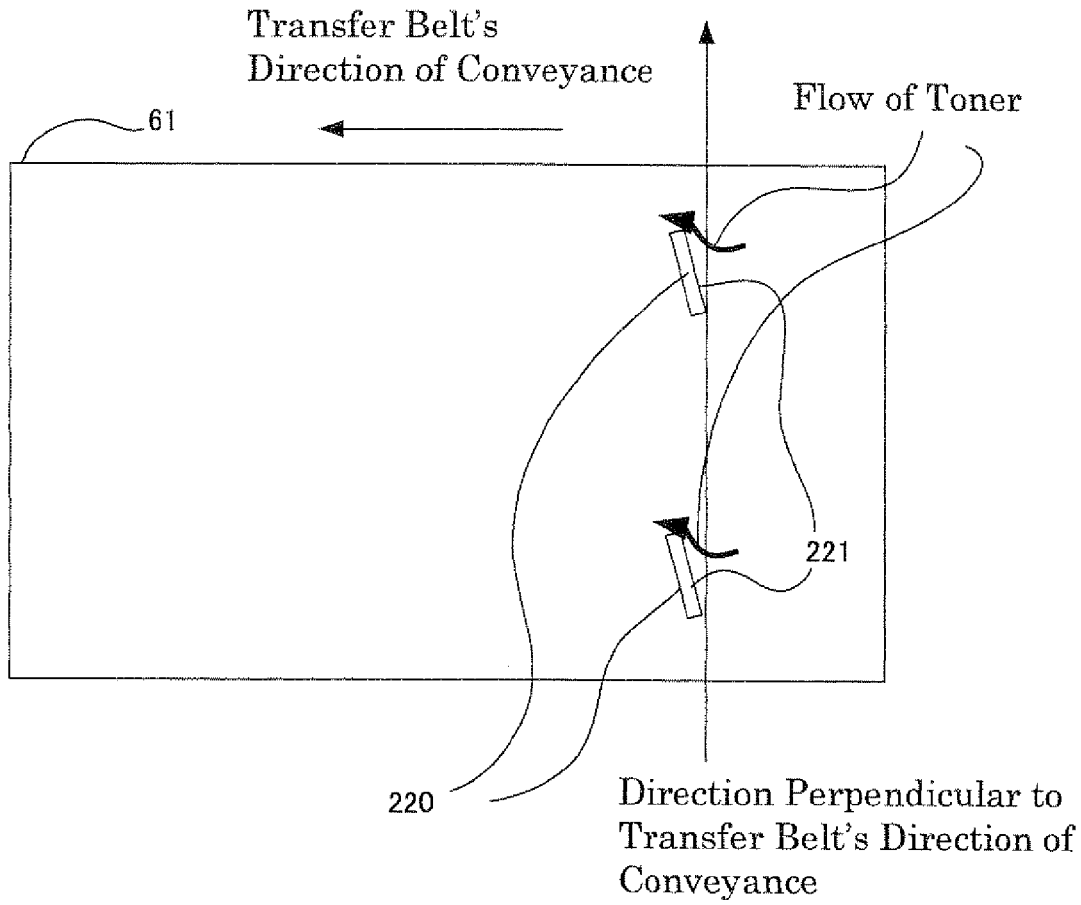

FIG. 21 shows the transfer belt 61 from the top thereof. When the shutter 152 is closed, the cleaning members 220 are abutted against the transfer belt 61 by the action of the separation/contact assembly 230 (FIG. 19A) and positioned obliquely to the direction perpendicular to the transfer belt 61's direction of conveyance in the state where cleaning member 220 is in contact with transfer belt 61. That is, the cleaning face, designated at 221, of cleaning member 220 abutting transfer belt 61 is arranged obliquely to the direction perpendicular to the transfer belt 61's direction of conveyance. The arrangement of cleaning member 220 in this way suppresses the increase of friction, making it possible to reduce the increase of the driving force required for driving transfer belt 61. Further, the oblique positioning of cleaning face 221 of the cleaning member 220 relative to the direction perpendicular to the direction of conveyance makes it possible to turn aside the toner cleaned by the cleaning member 220 in the transfer belt's direction of conveyance and prevent toner from building up on the cleaning member 220.

The image forming apparatus of the present technology should not be limited to the above embodiment. It is obvious that various changes and modifications may be added without departing from the spirit and scope of the technology.

What is claimed is:

1. An image forming apparatus with a transfer belt cleaning function comprising:

a transfer belt on which a toner image on a photoreceptor is transferred;

a secondary transfer unit for transferring the toner image on the transfer belt to a recording medium;

an optical sensor for detecting a reference toner image on the transfer belt;

a shutter for protecting the detecting surface of the optical sensor;

an opening/closing portion for opening and closing the shutter;

a controller for detecting the opening and closing of the shutter from the output from the optical sensor and controlling the opening and closing of the shutter based on the detected result;

a cleaning member, disposed on the upstream side of the detecting surface of the optical sensor in a direction of transfer belt being carried, for cleaning the surface of the transfer belt, wherein the cleaning member is arranged obliquely to the direction perpendicular to the direction of the transfer belt being carried when the cleaning member contacts the transfer belt; and a cleaning member separation/contact assembly which moves the cleaning member away from the surface of the transfer belt when the shutter is opened and brings the cleaning member into contact with the surface of the transfer belt when the shutter is closed.

2. The image forming apparatus with a transfer belt cleaning function according to claim 1, wherein a plurality of optical sensors are provided, and the cleaning member and the cleaning member separation/contact assembly are provided for each of the optical sensors.

3. The image forming apparatus with a transfer belt cleaning function according to claim 1, wherein the time from the state where the shutter of cleaning member separation/contact assembly is closed to the state where the cleaning member is moved away from the transfer belt is equal to or shorter than the time taken for the shutter in the opening and closing portion to move from the open position to the closed position.

4. The image forming apparatus with a transfer belt cleaning function according to claim 1, wherein when the reference toner image has been transferred to the transfer belt, the controller causes the opening and closing portion to open the shutter so that the cleaning member separation/contact assembly moves the cleaning member away from the transfer belt before the arrival of the reference toner image to the cleaning position of the cleaning member.

5. The image forming apparatus with a transfer belt cleaning function according to claim 1, further comprising:

a separation/contact mechanism for the transfer belt and the secondary transfer unit; and, a linkage mechanism for linking the opening and closing of the shutter with the separation and contact of the secondary transfer unit.

6. The image forming apparatus with a transfer belt cleaning function according to claim 5, wherein the linkage mechanism moves the shutter away from the transfer belt when the secondary transfer unit is pulled out from the main apparatus body.

7. The image forming apparatus with a transfer belt cleaning function according to claim 6, wherein the linkage mechanism includes a lever that abuts the secondary transfer unit and the shutter, the lever being moved by a driving mechanism so as to move the shutter and the secondary transfer unit into, and out of, contact with each other.

8. The image forming apparatus with a transfer belt cleaning function according to claim 1, wherein the optical sensor is a sensor that detects the density of a reference toner image on the transfer belt.

9. The image forming apparatus with a transfer belt cleaning function according to claim 1, wherein the optical sensor is a sensor that detects the position of a reference toner image of the transfer belt.

10. The image forming apparatus with a transfer belt cleaning function according to claim 1, wherein, when a plurality of optical sensors are provided, the optical sensors are adapted to use a common shutter.

11. The image forming apparatus with a transfer belt cleaning function according to claim 1, wherein the controller monitors change of the output from the optical sensor and performs an error process when no change has been observed for a predetermined period of time or longer.

* * * * *